US005615478A

United States Patent [19]

Celoudoux et al.

[11] Patent Number: 5,615,478

[45] Date of Patent: Apr. 1, 1997

[54] WIRE HANDLING GRIPPERS; PROCESS AND APPARATUS FOR MANUFACTURING OF ELECTRICAL CABLE BUNDLES USING THESE GRIPPERS

[75] Inventors: Jean P. Celoudoux, La Barque; Michel Verhille, Peynier, both of France

[73] Assignee: L'Entreprise Industrielle, Paris, France

[21] Appl. No.: 167,834

[22] PCT Filed: Jun. 19, 1992

[86] PCT No.: PCT/FR92/00558

§ 371 Date: Mar. 6, 1995

§ 102(e) Date: Mar. 6, 1995

[87] PCT Pub. No.: WO93/00730

PCT Pub. Date: Jan. 7, 1993

[30] Foreign Application Priority Data

Jun. 21, 1991 [FR] France ..... 91 08132

[51] Int. Cl.[6] ..... H01R 43/04

[52] U.S. Cl. ..... 29/845; 29/33 M; 29/748

[58] Field of Search ..... 29/33 M, 747, 29/748, 842, 845, 861

[56] References Cited

U.S. PATENT DOCUMENTS

| | | | |
|---|---|---|---|
| 3,939,552 | 2/1976 | Hart et al. | 29/748 X |
| 4,742,613 | 5/1988 | Yamaguchi et al. | 29/759 |
| 4,864,718 | 9/1989 | Ricard | 29/747 X |
| 5,309,633 | 5/1994 | Ricard | 29/33 M X |

FOREIGN PATENT DOCUMENTS

| | | | |
|---|---|---|---|
| 0305307 | 3/1989 | European Pat. Off. . | |
| 0403350 | 12/1990 | European Pat. Off. . | |
| 481901 | 4/1992 | European Pat. Off. | 29/747 |
| 302804 | 1/1994 | European Pat. Off. | 29/33 M |
| 2636494 | 3/1990 | France | 29/33 M |
| 2003759 | 3/1979 | United Kingdom . | |
| 8905047 | 6/1989 | WIPO | 29/748 |

*Primary Examiner*—Peter Vo

*Attorney, Agent, or Firm*—Dvorak and Traub

[57] ABSTRACT

The present invention relates to wire handling grippers, a process and an apparatus for manufacturing electrical cable bundles which use these grippers. The grippers comprise ar least one sweep arm and an internal articulated arm that can gather the wire ends inserted into openings of a component and the grippers comprise two external articulated arms which can gather wires in an area that is further away from the component, which grippers can move along a guide.

8 Claims, 13 Drawing Sheets

YY31
20
19
ZZ3
10
XX5
25
YY3
Δ
5
20a
20b
23
11
25

YY31
20
19
ZZ3
10
XX5
25d
YY3
18a
25a
α
25
20a
20b
23
11
25

YY31
20
19
ZZ3
10
XX5
25
YY3
18a
11
25
20a
20b
23

YY31
VII
VIII
20
20a
20b
ZZ3
23
10,11
25c
VII
25
70
L2
6
L1
F
VIII
25b
YY32
21
19
21a
21b
22
23
12
25
ZZ8
XX1

WIRE HANDLING GRIPPERS; PROCESS AND APPARATUS FOR MANUFACTURING OF ELECTRICAL CABLE BUNDLES USING THESE GRIPPERS

BACKGROUND OF THE INVENTION

1. Field of the Invention

The present invention relates to wire handling grippers and more especially to an apparatus and process for manufacturing electrical cable bundles using these grippers. The present invention relates to the automatic manufacturing of "simple" electrical bundles. The term "simple" bundles is taken to mean electrical bundles comprising about ten electrical components of differing types, into which the ends of wire sections are inserted; it also includes a maximum of approximately twenty components per bundle. Moreover, the present invention applies more specifically to cable bundles comprising electrical components individually having a relatively limited number of openings, and more specifically to cable bundles comprising components in which the openings are arranged less than in three rows.

2. Background of the Prior Art

Different processes and apparatuses involved in the manufacturing of electrical cable bundles are already known.

Patent application FR 2 636 494 (RICARD) describes a process and apparatuses designed to insert electrical wire ends into components. According to this document, the components are fitted on a pallet which can move along two rectangular axes. An insertion head which confronts the pallet, grips insertion gripper devices in which the wire ends are held. The insertion grippers are adapted to suit the shape of the crimped terminal on the wire end. Patent application EP 302 804 (RICARD) also describes a process and apparatuses for crimping wire ends onto connections. According to this document the wire ends are held by grippers conveyed along carrier strips aligned with one another, and are transferred from a first carrier strip to a second carrier strip by a manipulator arm fitted with at least one gripper device.

Patent application EP 305 307 describes grippers fitted on automatic cable-making machine carrier strips which are designed to hold one or several wires. The grippers comprise two pairs of claws separated by an intermediate space in which a piston is pushed towards the tip of the gripper by a spring.

The general problem not addressed by any of these patented processes or devices is to provide a process and apparatus for manufacturing electrical cable bundles from wire sections which have ends that have been previously prepared and/or stripped. At present, there is no known process nor apparatus for manufacturing electrical cable bundles that will accommodate industrial implementation. The processes and apparatuses described in application FR 2 636 494 have a certain number of inconveniences, the main one being that the machine described therein is bulky and complex. Further, the process described in this document involves repeated handling of the wire sections as well as complex movements of the wire ends and the components, into which the wire ends are to be inserted.

Moreover, documents EP 302 804 end EP 305 307 do not describe actual processes and apparatuses which allow insertion of the wire ends, and hence, the manufacturing of electrical cable bundles.

SUMMARY OF THE INVENTION:

It is the primary goal of the present invention to provide a process and apparatus capable of rapidly inserting the wire ends into the openings of the components and which delivers a completed cable bundle which can be rapidly handled once it has been manufactured, thereby ensuring high production rates.

Another object of the invention is to provide a process and apparatus which can handle the bundles in-process and post-process wherein complete bundles can be bound and dispatched for utilization The apparatus of the present invention consists of a gripper device called gathering grippers for handling electric wire, the ends of which can be inserted into openings of components placed near a horizontal linear carrier strip, which comprises at least one rigid sweep arm, and an internal sweep arm acts in conjunction with the rigid sweep arm to gather the wire ends inserted into the openings of the components in the vicinity of that component. The gripper comprises two articulated external arms which cooperate to gather the wires, the ends of which are inserted on the component in a zone that is at a predetermined distance from the component, which wire and gathering grippers move along a guide rail which is parallel to the carrier strip.

The internal articulated arm are actuated by a first linear cylinder and the external articulated arms are actuated by a second linear cylinder by means of a beam.

It is of advantage that the articulated arms extend in closed position according to a vertical axis $YY_3$, which arms are articulated around a horizontal axis which cuts the vertical axis $YY_3$ and in that the thrust axis $YY_{32}$ of the 2nd linear cylinder which is parallel to the vertical axis $YY_3$, is not very distant from the vertical axis $YY_3$, so as to cause an asymmetrical movement (out of phase in time) of the external articulated arms.

It is of advantage that the arms of the gathering grippers are equipped at their lower end with at least one claw in the shape of a V, the internal edges of which form an angle between 60 degrees and 120 degrees and preferably around 90 degrees.

It is of advantage that one of the claws of the arms comprises at least two flat parts that are parallel to each other which, when the gathering grippers are closed, can at least partly covers part of the corresponding claw or the claw itself.

It is of advantage that an apparatus for manufacturing electrical cable bundles comprising a first horizontal linear carrier strip of axis $XX_1$, which can move transfer grippers, each pair of adjacent transfer grippers capable of holding a wire section; the apparatus comprises a second horizontal linear carrier strip which can move support grippers (capable of holding several wire ends), the apparatus comprising at least two mating grippers each of which can extract from the transfer grippers and the support grippers and can introduce into the support grippers at least one wire end; the mating grippers can move along a guide rail of axis $XX_4$ parallel with the axis $XX_1$; the apparatus also comprises at least one wire and gathering gripper with at least one sweep arm; the gathering gripper can move along the guide rail independently of the movements of the mating grippers.

It is of advantage that the apparatus for manufacturing electrical cable bundles comprises a device which moves the components relative to the wire ends held in the mating grippers along a curved trajectory in the arc of a circle which is contained within a plane perpendicular to the axis $XX_1$.

The solution to the problem also consists in finding a process and apparatus for manufacturing electrical cable bundles comprising the following operations:

a—an apparatus for manufacturing electrical cable bundles according to the invention;

b—the two ends of a wire that has been previously placed in one of the transfer grippers are gripped using at least two of the mating grippers by means of vertical movements according to the respective axes $YY_1$, $Y_2$ of the mating grippers;

c—the mating grippers are moved according to axis $XX_4$ on the guide, so as to position at least one end of the wire on one of the vertical planes containing the axis of an opening of a component which is held on a mobile insertion support;

d—the component and the mobile insertion support are made to follow curved insertion trajectory;

e—the non inserted end of the wire held by the mating grippers is inserted in one of the support grippers;

f—the claws of the mating grippers are opened and the mating grippers are moved in order to position them opposite the grippers that transfer the wire sections, and at the same time, when the component is linked to all the wire ends that are to be inserted into the openings of component:

$f_1$—the gathering pliers are moved according to the axis $XX_4$ by means of the guide, to allow the bottom of the claw of the sweep arm to move according to a horizontal axis found at the same height (called the insertion height) as the openings of the component;

f2—when the sweep claw 1*a* found opposite the component, the internal articulated arm is activated co as to gather near the component the end of the wires which have been inserted into the component to form a braid which is held by the claws of the internal articulated arm and the sweep arm.

f3—the external articulated arms are then activated to gather the ends of the wires which have been inserted into the component between the claws of the external articulated arms in an area further away from the component.

the component is separated from the mobile insertion support.

the gathering grippers are moved according to the axis $XX_4$ in order to place the braid consisting of the ends gathered opposite one of the support grippers.

the braid, at the and of which the component is suspended, it held in the support grippers.

By means of the handling grippers according to the invention, it is easy to grip, gather and handle at least one electrical wire section end and in particular several electrical wire ends can be handled, ends which have previously been inserted into the openings of electrical components and which are, due to this fact, a certain distance from each other; by means of the rigid sweep arm of the grippers which can move on the guide rail parallel to the axis of a carrier strip, the wire ends previously inserted into the component can be grouped by a sweep movement in the immediate vicinity of the component and by the closure of the internal articulated arm the gathered ends can be collected in the immediate vicinity of the component; moreover, by means of the external articulated arms the wire ends can then be gathered and gripped in a section of the wire sections that is significantly further away from the component than the section of the wire sections which have been gathered and gripped by the rigid arm and the internal articulated arm, which makes it possible to then handle and transfer all the ends gathered and inserted in this way, as well as the component held at the wire ends, making it possible to come and place the ends in the claws of a transfer grippers found on the carrier strip.

By means of the first and second linear cylinders, it is possible to successively command (sequentially) the movements of the internal articulated arm and then the external articulated area, which facilitates the gathering of the wire ends which have already been gathered in a section that is closer co the component, using the rigid sweep arm and the internal articulated arm.

Due to the offset between the thrust axis of the second linear cylinder and the general vertical axis $YY_3$ of the grippers, which causes the asymmetrical movement of the external articulated arms, one of the external articulated arms will be (in closed position) made to systematically align with the rigid sweep arm, the other external articulated arm being consequently aligned with the internal articulated arm, irrespective of the number of wire ends that have been gripped and gathered by the grippers, and this makes it possible to hold and handle the wire ends according to the general axis of the wire ends which is perpendicular to a plane containing the movement trajectories of the articulated arms; this makes it possible to know with relative accuracy, the position of the axis according to which the wire ends gripped and gathered by the grippers extend and which makes it possible consecutively to the gathering operations of the wire ends, to come and place the gathered ends in any type of prehensile apparatus such as, for example, transfer grippers.

By means of the claws in the shape of a V equipping the arms of the gathering grippers, the ends can be gathered quickly and regularly and according to a predetermined shape which facilitates handling.

Moreover, the invention makes it possible to find an apparatus for manufacturing electrical cable bundles which ensures very high performance especially as concerns the manufacturing rate of the electrical cable bundles and the handling rate of the wire ends and insertion of the ends of the openings of electrical components.

DETAILED DESCRIPTION OF THE DRAWINGS

The numerous advantages of this invention will be more readily understood from the following detailed description which is represented in the drawings wherein.

Figure 4A:
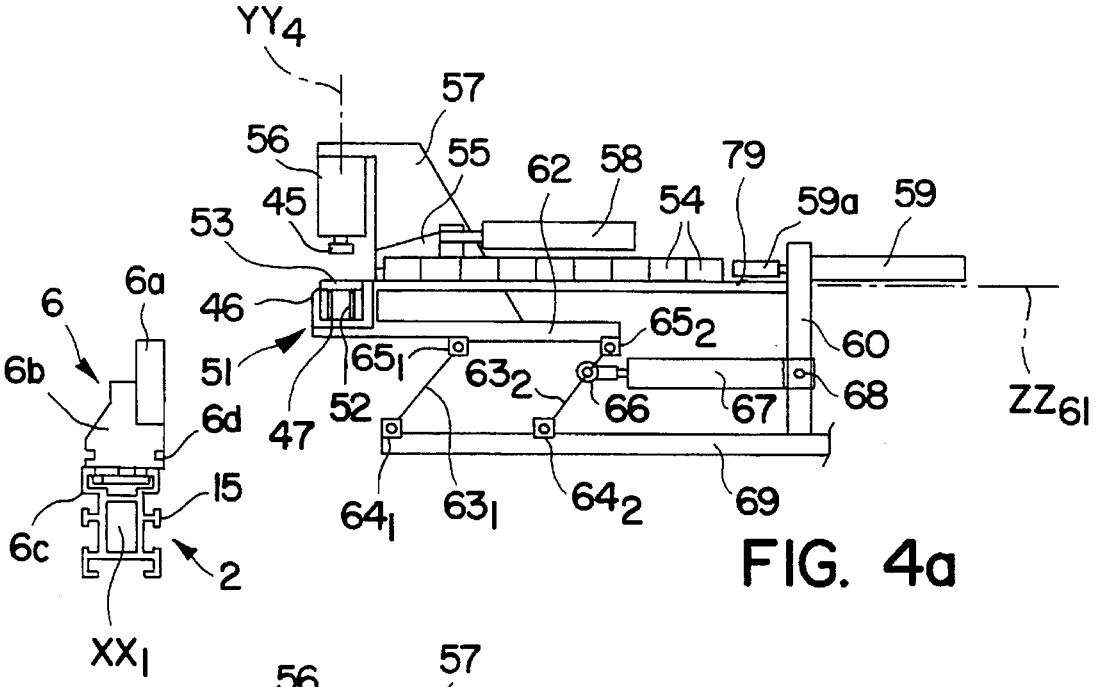

FIG. 4*a* shows an end view of a device for insertion of wire ends into components according to the invention and show the main operations involved in the insertion process according to the invention.

Figure 4B:
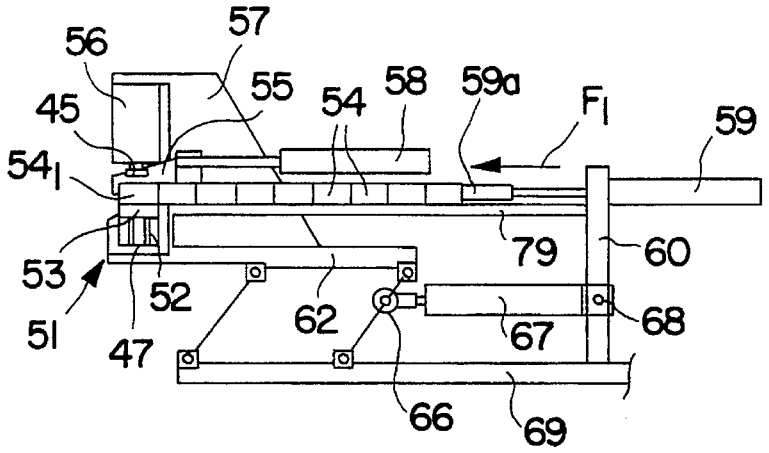

FIG. 4*b* shows an end view of a device for insertion of wire ends into components according to the invention and shows the first operation involved in the insertion process.

Figure 4C:
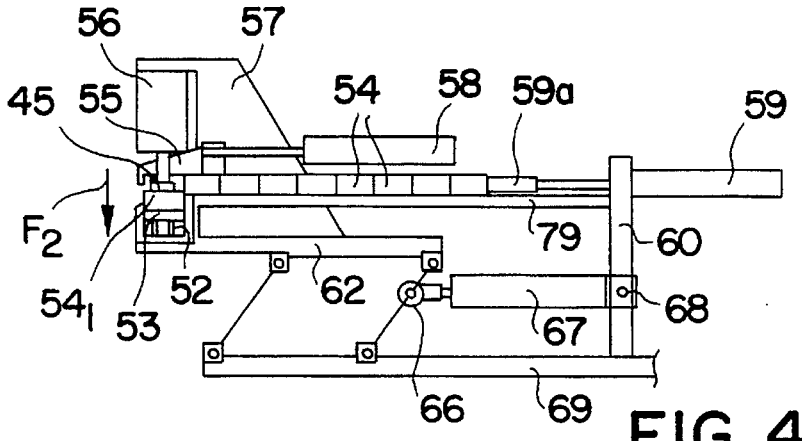

FIG. 4*c* is an end view of the device of FIG. 4*b* and shows a second operation involved in the insertion process.

Figure 4D:
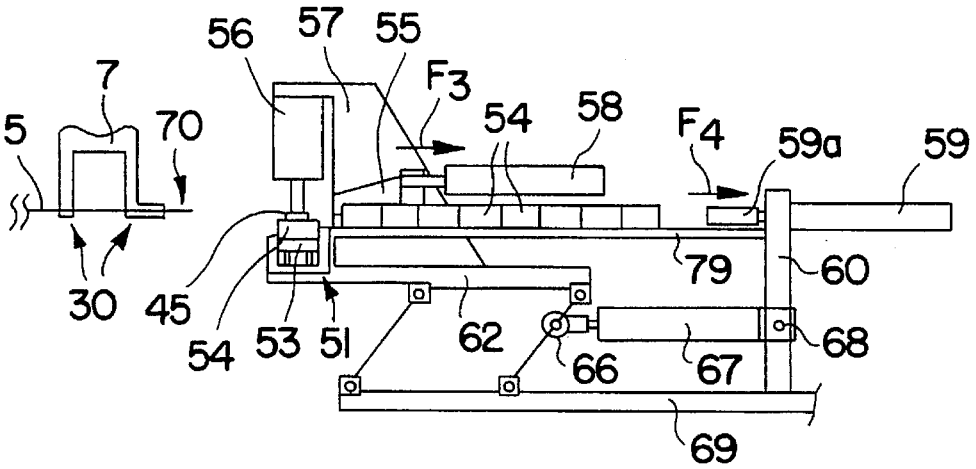

FIG. 4*d* is an end view of the device of FIG. 4*c* and shows the third operation involved in the insertion process.

Figure 4E:
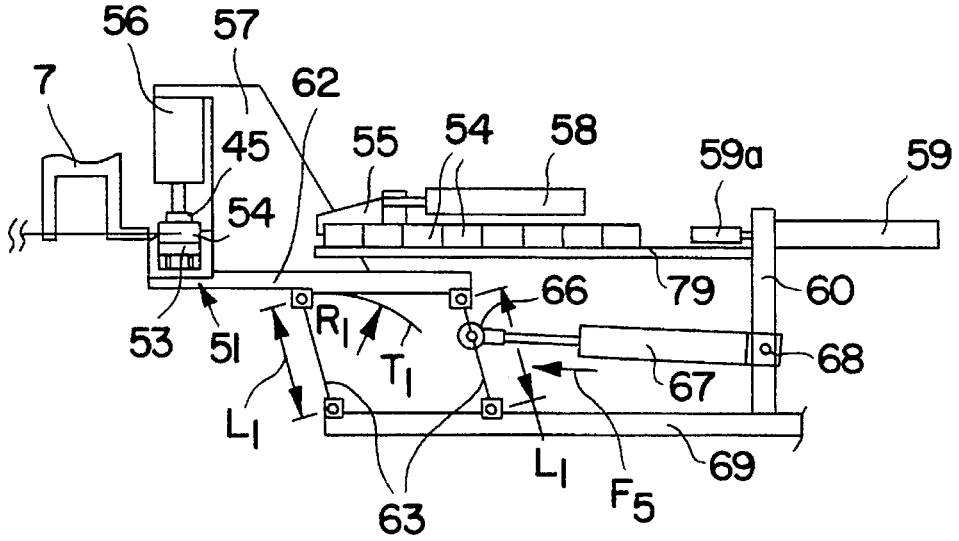

FIG. 4*e* is an end view of the device of FIG. 4*d* and shows the fourth operation involved in the insertion process.

Figure 4F:
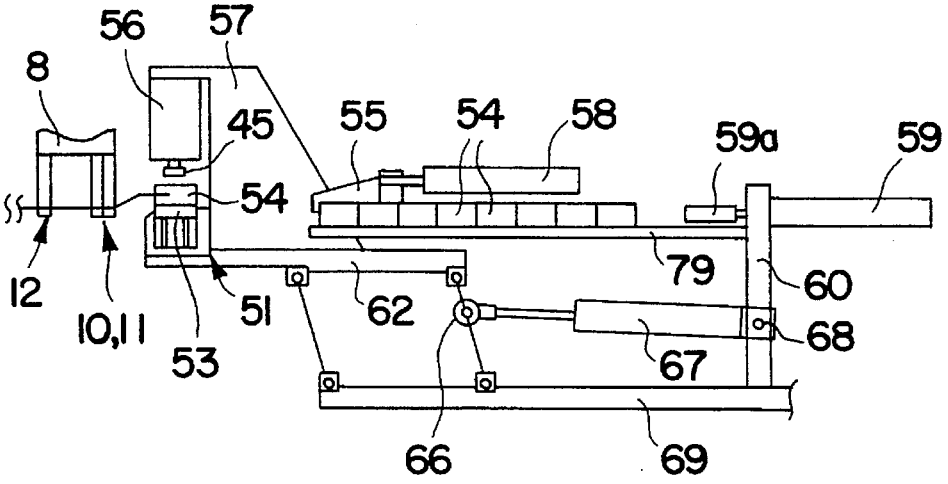

FIG. 4*f* is an end view of the device of FIG. 4*e* and shows the fifth operation involved in the insertion process.

Figure 4G:
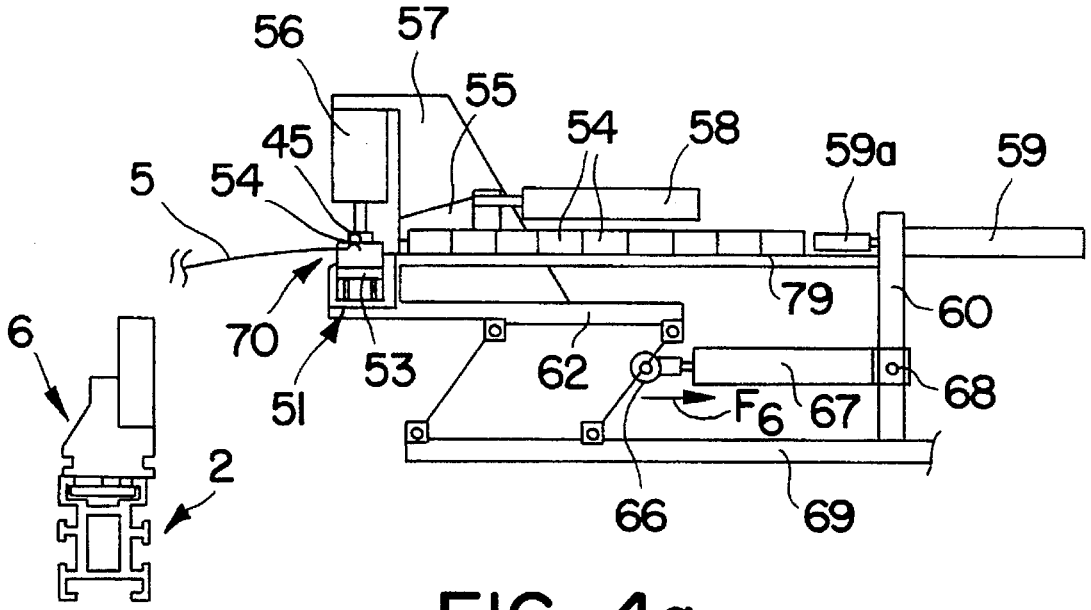

FIG. 4*g* is an end view of the device of FIG. 4*f* and shows the sixth operation involved in the insertion process.

Figure 4H:
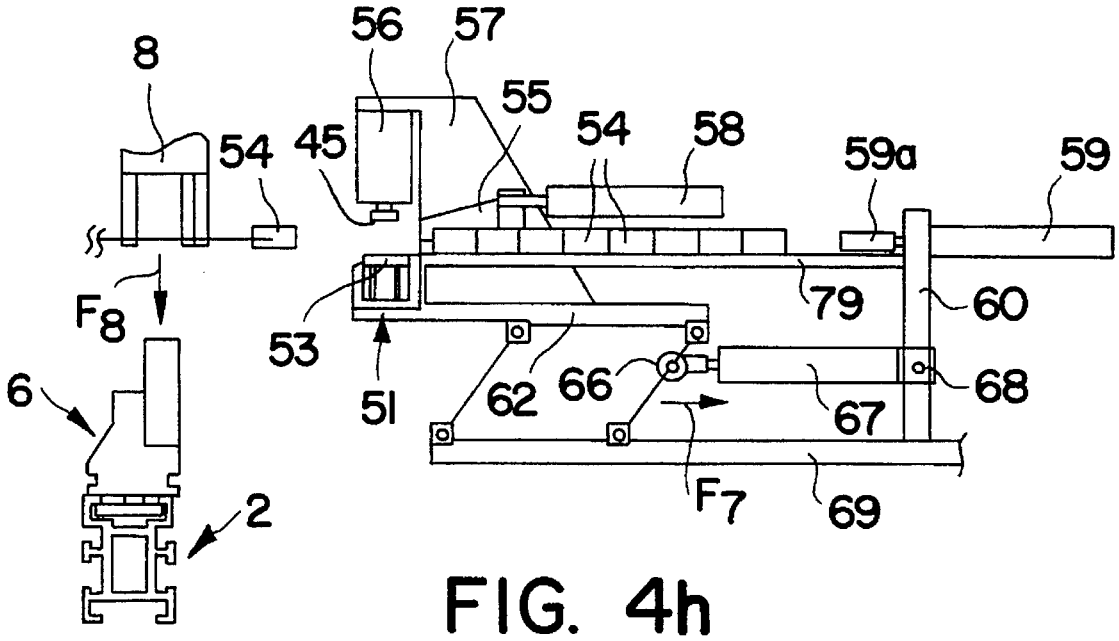

FIG. 4*h* is an end view of the insertion device showing an operation in the insertion process following the phrase shown in FIG. 4*g*.

Figure 5B:
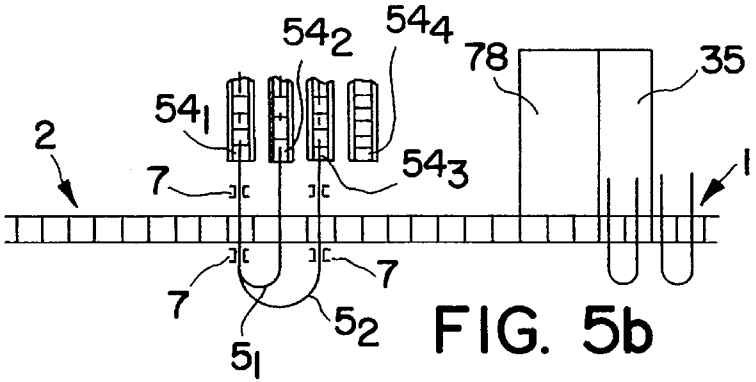
Figure 5D:
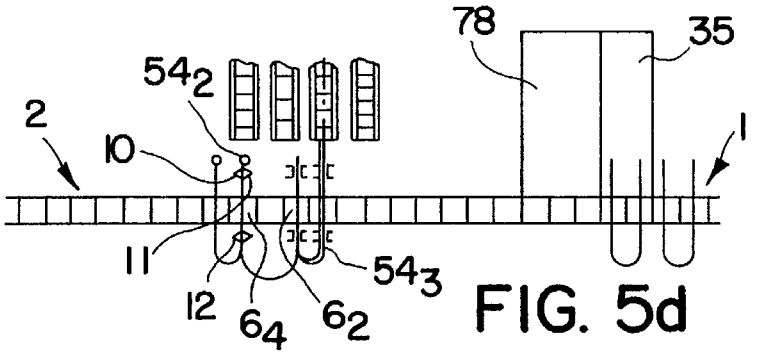
Figure 5F:
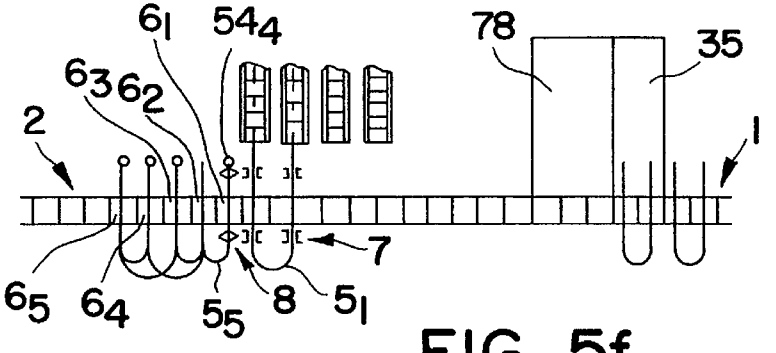
Figure 5A:
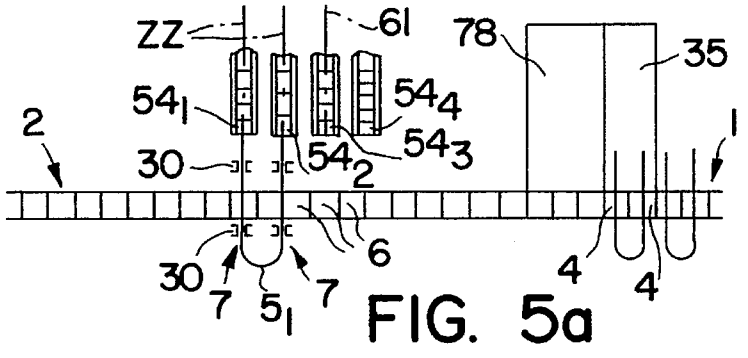

FIG. 5*a* is a schematic plan view of the main operations involved in the process for manufacturing electrical cable bundles.

FIG. 5*b* is the plan view of FIG. 5*a* showing the next operation involved in the process for manufacturing electrical cable bundles.

Figure 5C:
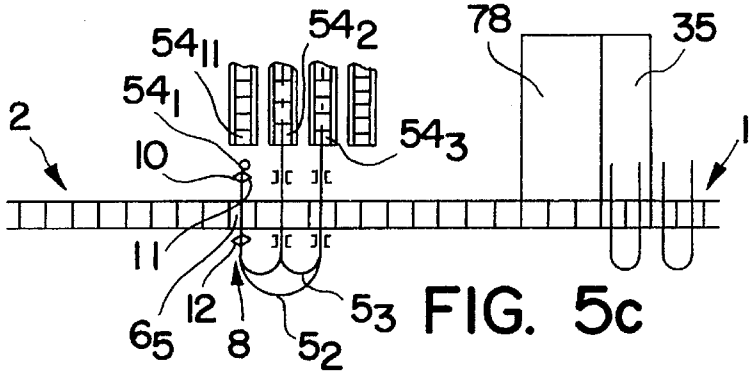

FIG. 5*c* is the plan view of FIG. 5*b* showing the next operation involved in the process for manufacturing electrical cable bundles.

FIG. 5*d* is the plan view of FIG. 5*c* showing the next operation involved in the process for manufacturing electrical cable bundles.

Figure 5E:
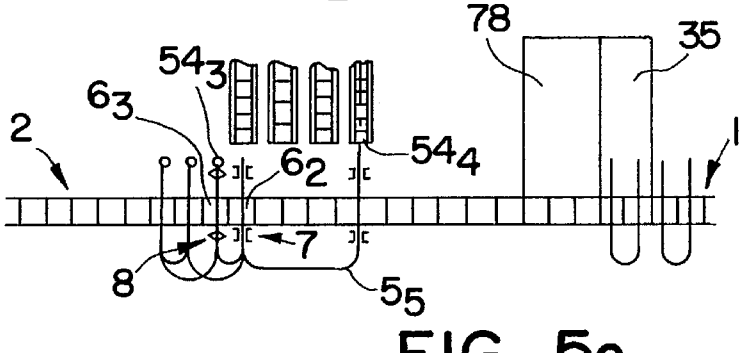

FIG. 5*e* is the plan view of FIG. 5*d* showing the next operation involved in the process for manufacturing electrical cable bundles.

FIG. 5*f* is the plan view of FIG. 5*c* showing the next operation involved in the process for manufacturing electrical cable bundles.

Figures 6, 7A, 7B, 7C:
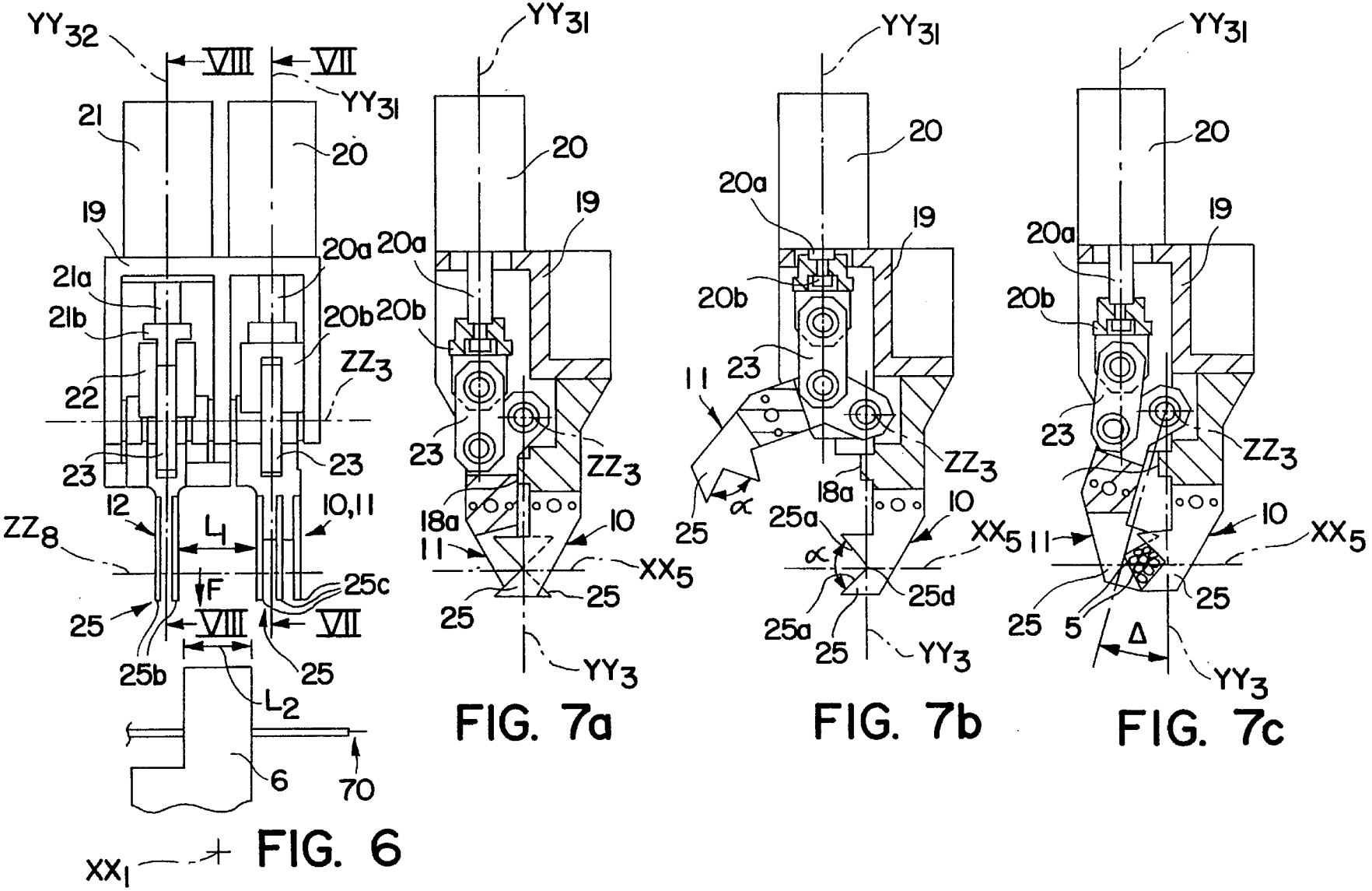

FIG. 6 shows a gathering gripper for an apparatus for manufacturing electrical cable bundles according to the invention.

FIG. 7*a* shows a closed sweep arm and internal articulated arms of the gathering gripper according to the invention.

FIG. 7*b* shows an open sweep arm and open internal articulated arms of the gathering gripper according to the invention.

FIG. 7*c* shows the sweep and internal arms of a gathering gripper holding a cable bundle.

Figure 8C:
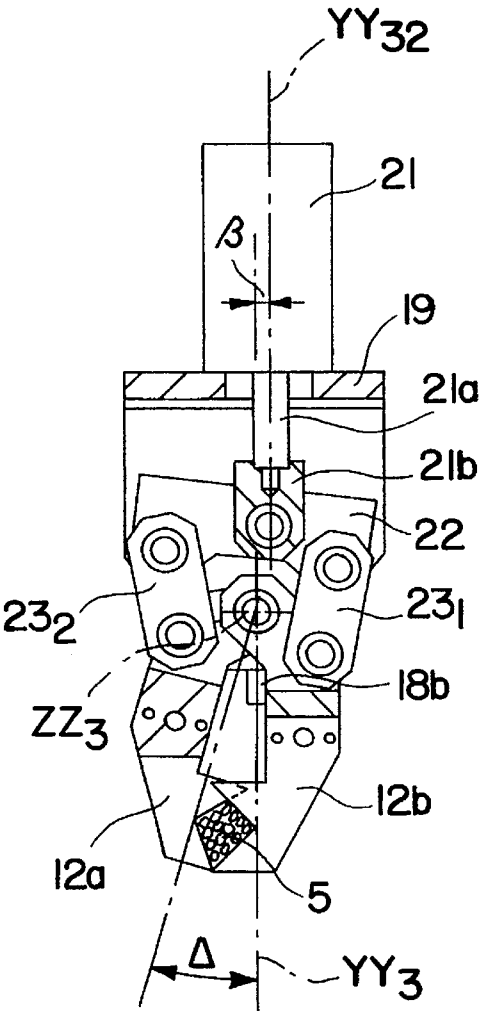
Figure 8B:
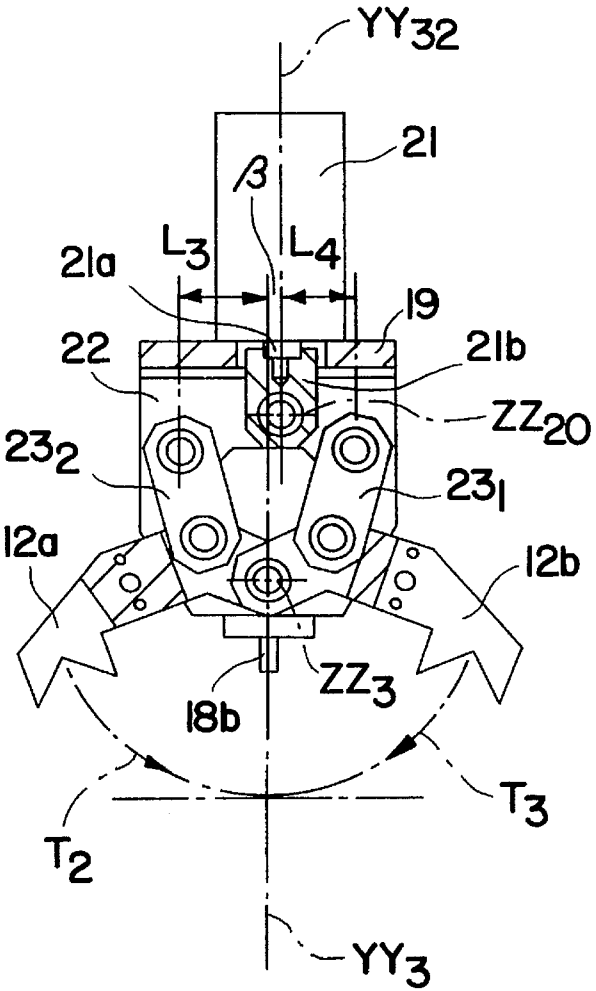
Figure 8A:
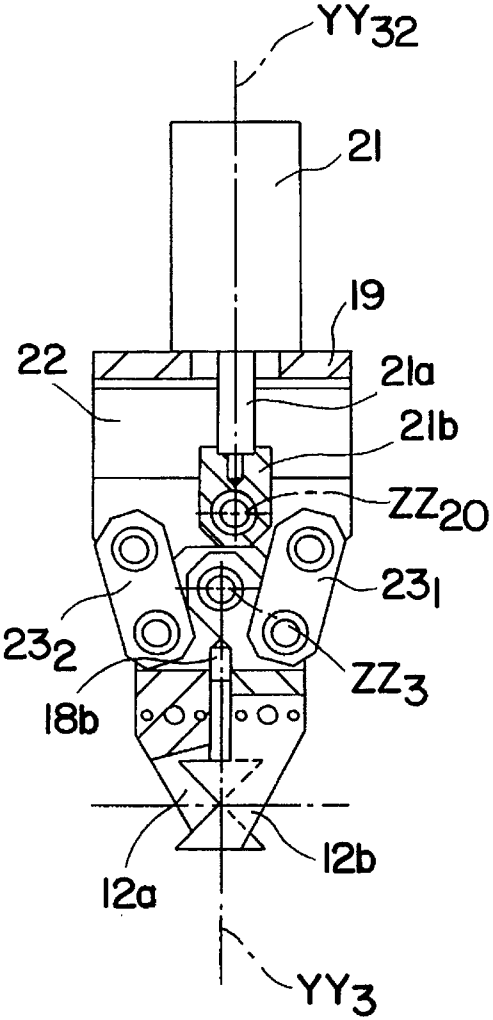

FIG. 8*a* shows the external articulated arms of the gathering gripper according to the invention.

FIG. 8*b* shows the external arms of the gathering gripper of FIG. 8*a* in an open position.

FIG. 8*c* shows the arms of the gathering gripper of FIG. 8*b* holding a cable bundle.

Figure 9:
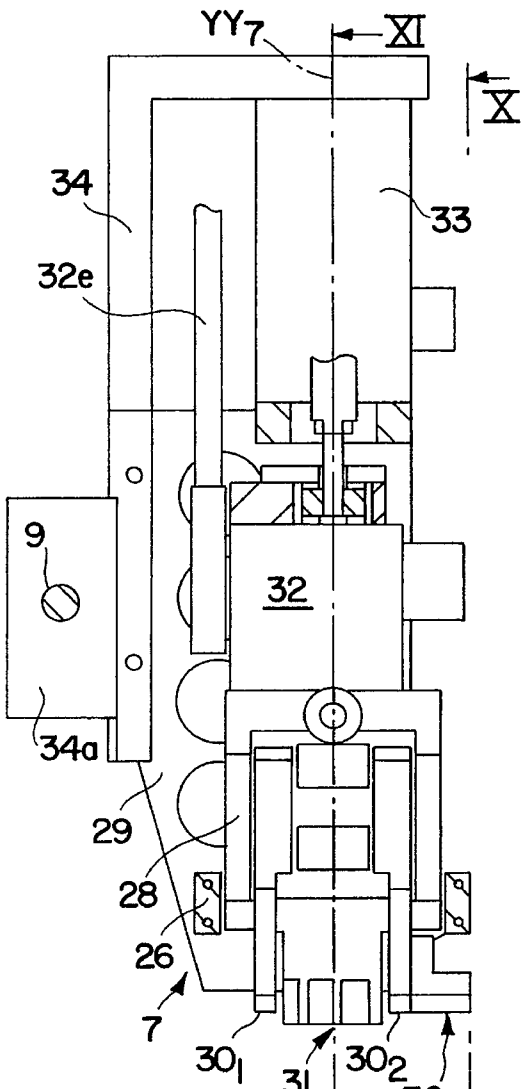

FIG. 9 shows a front view of the mating grippers for an apparatus according to the invention.

Figure 10:
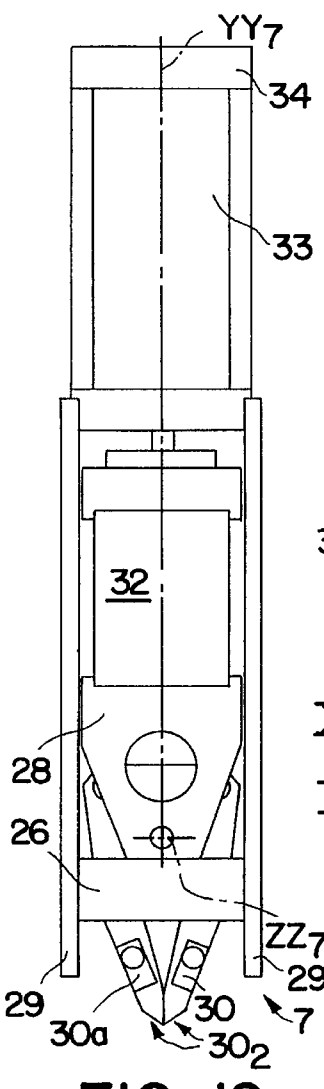

FIG. 10 shows a side view of the mating grippers for an apparatus according to the invention.

Figure 11:
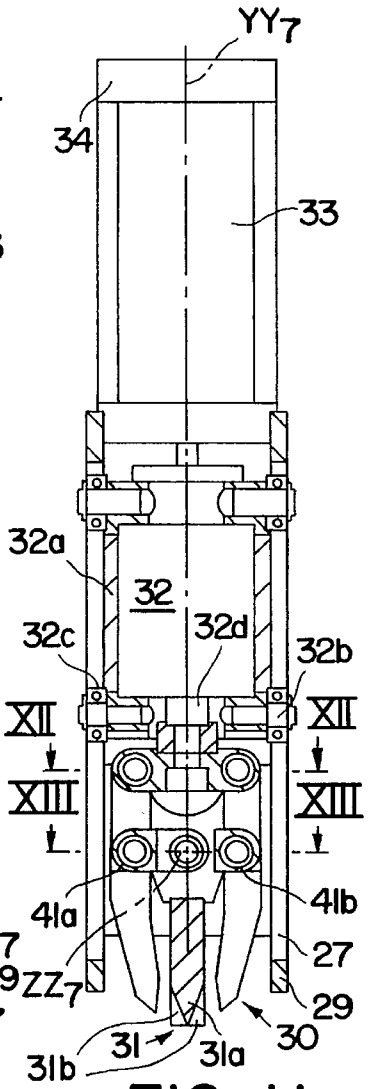

FIG. 11 shows an end view of the mating grippers for an apparatus according to the invention.

Figure 12:
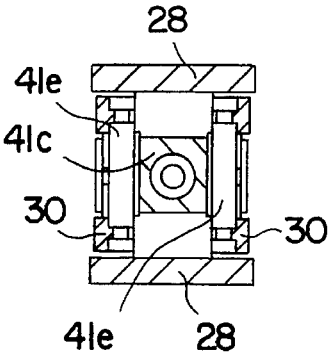

FIG. 12 shows a mobile assembly portion of the mating grippers shown in FIG. 11.

Figure 13:
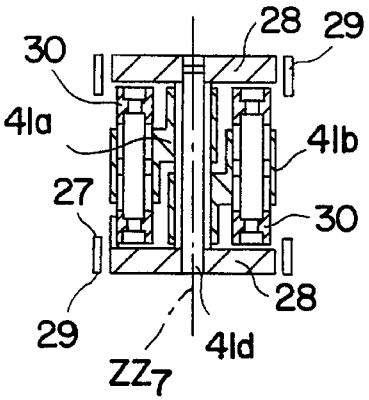

FIG. 13 shows another view of the mobile assembly portion shown in FIG. 12.

Figure 14:
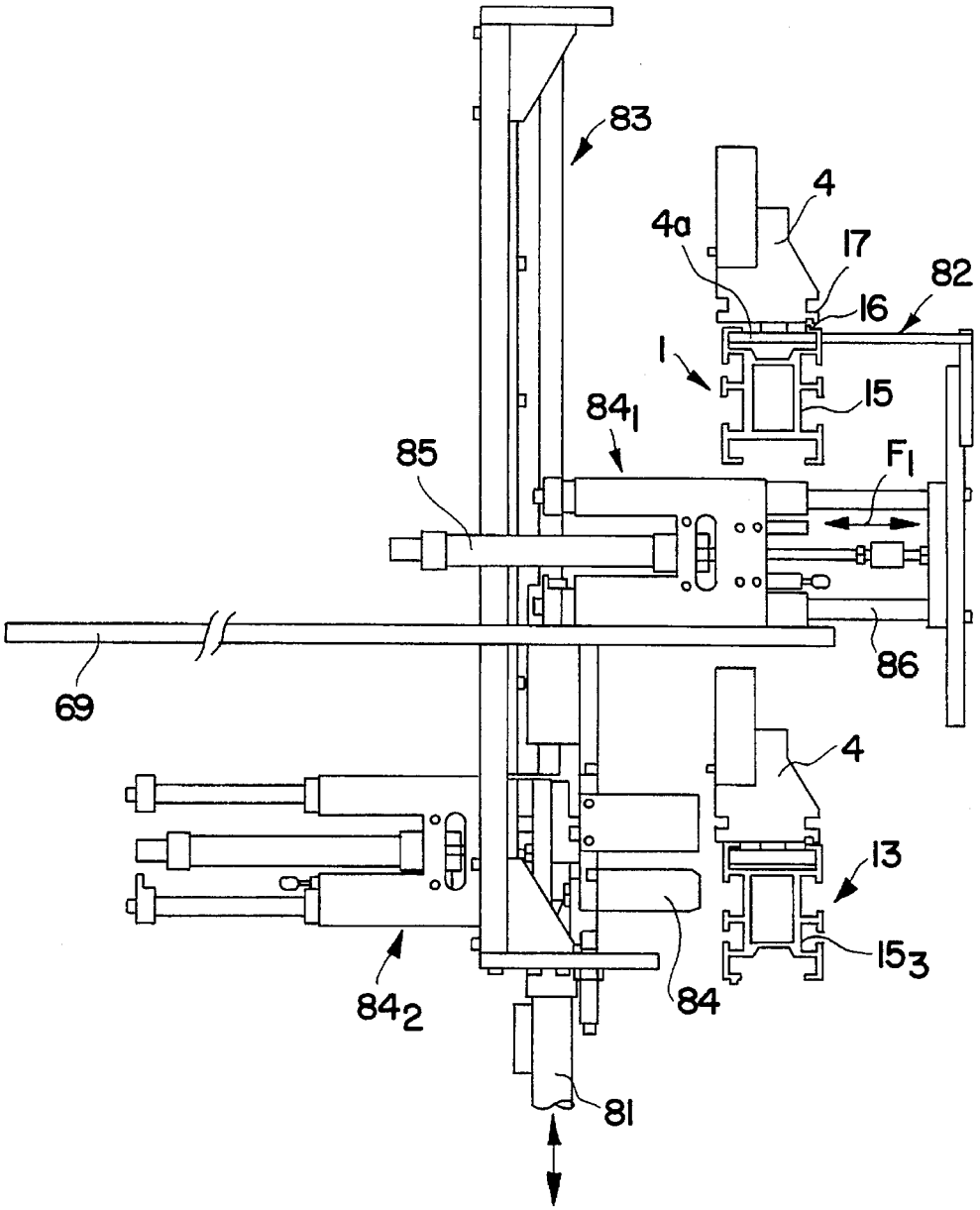

FIG. 14 shows an end view of a mode of embodiment of a device for transferring gripper transfers in an apparatus for manufacturing electrical cable bundles according to the invention.

Figure 15A:
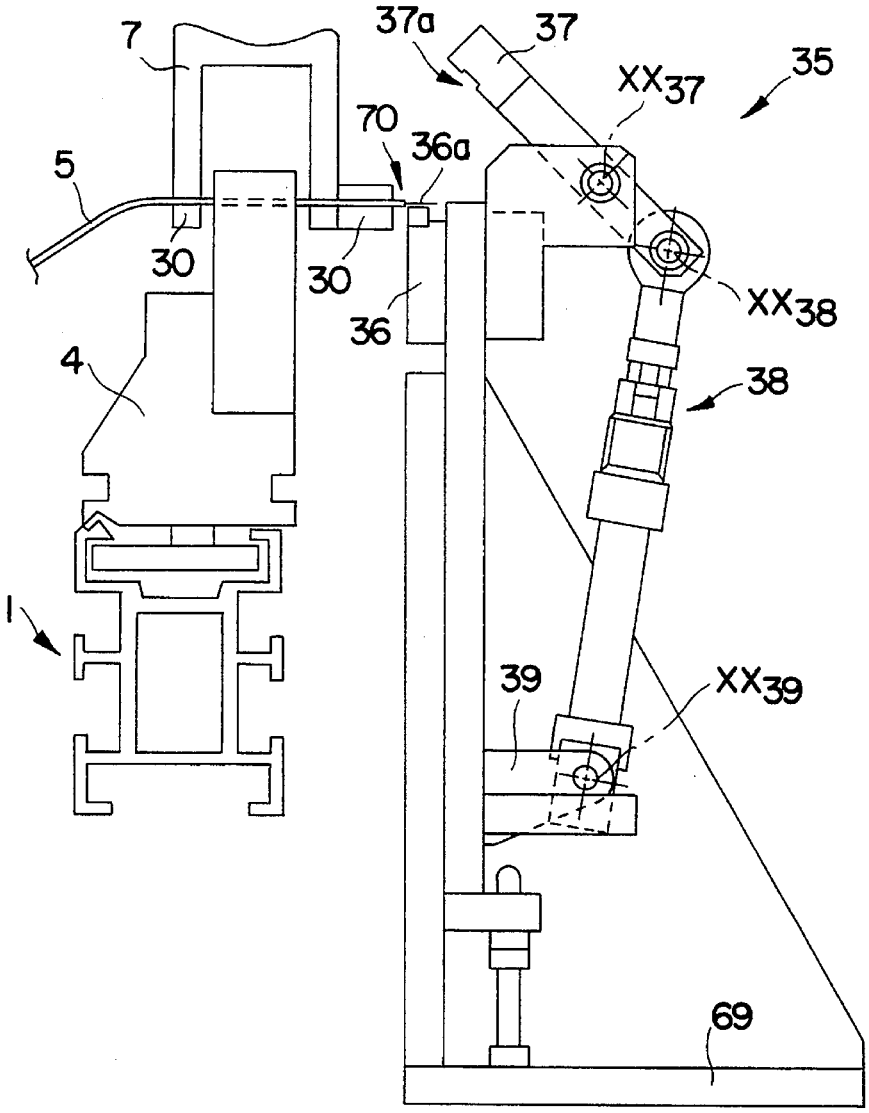

FIGS. 15*a* shows an end view of the next position of the vertical positioning device shown in FIG. 14.

Figure 15B:
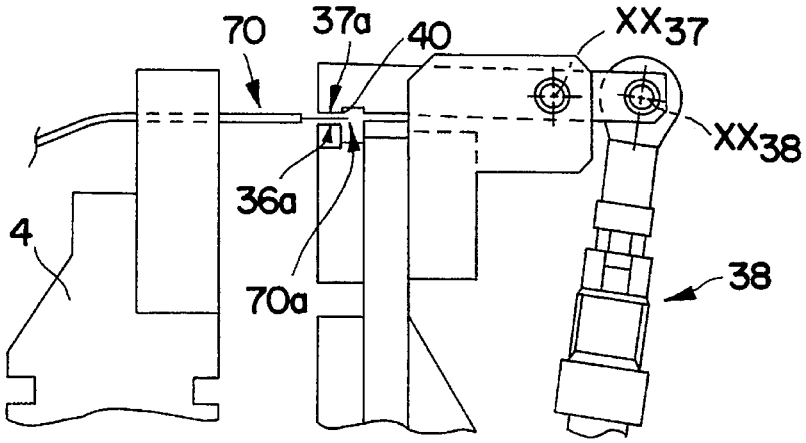

FIG. 15*b* shows a detailed end view of the positioning device of FIG. 15*a* in the final position.

Figure 16:
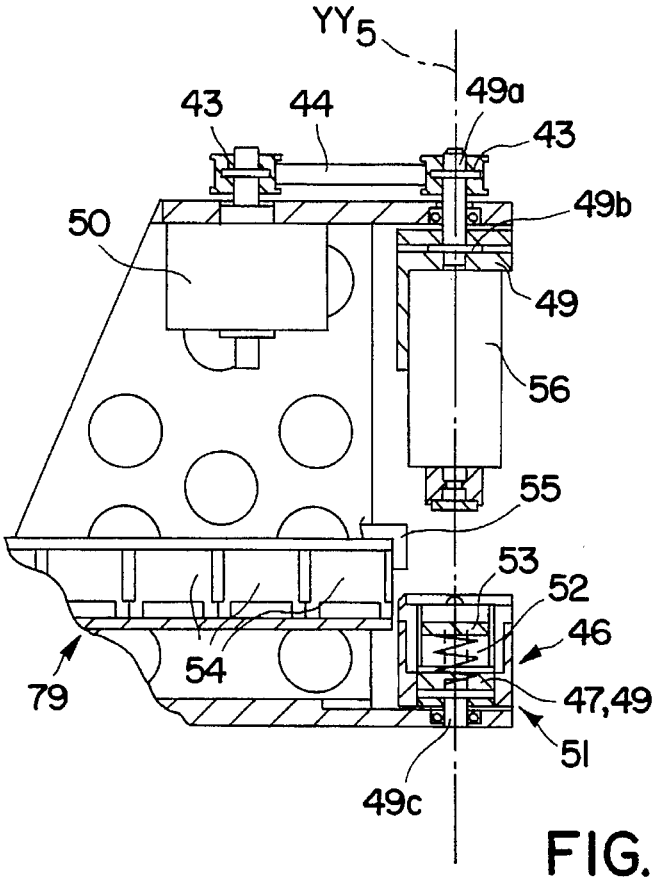

FIG. 16 shows an end view of an insertion device according to the invention.

Figure 17:
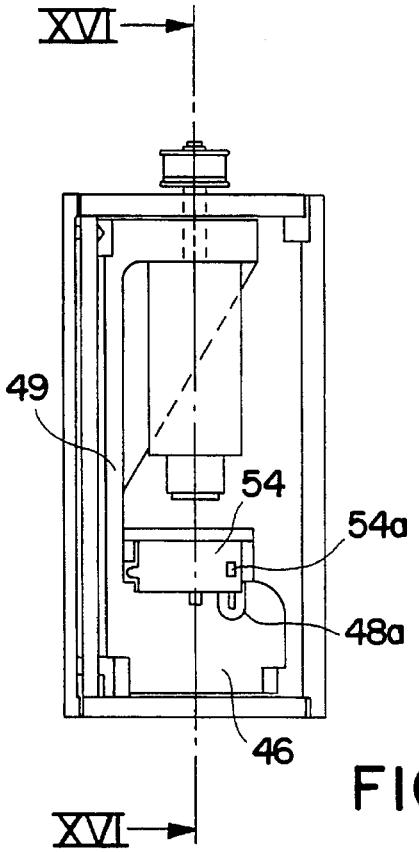

FIG. 17 shows a top view of the device of FIG. 16.

Figure 18A:
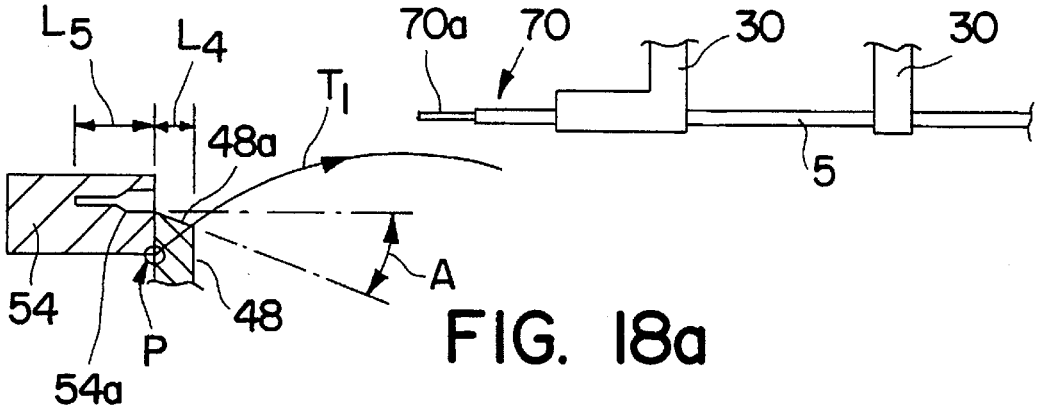

FIG. 18*a* shows the operations of a process to insert wire ends into openings in components according to the invention.

Figure 18B:
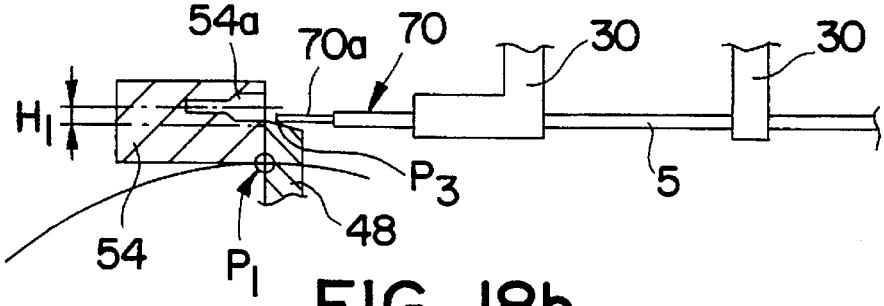

FIG. 18*b* shows the first operation of the process for inserting wire ends into openings in components according to the invention.

Figure 18C:
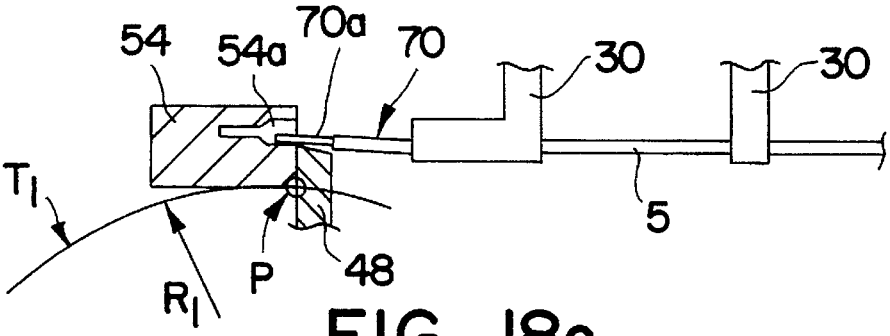

FIG. 18*c* shows the second operation of the process of FIG. 18*b*.

Figure 18D:
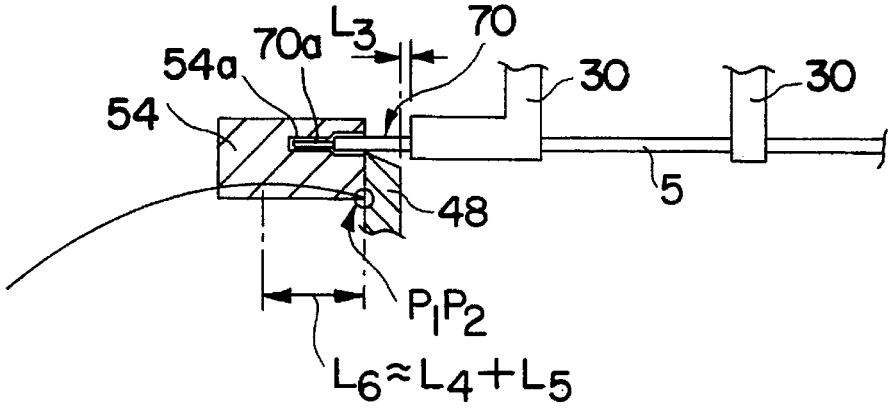

FIG. 18*d* shows the wire end being fully inserted into the opening in the component.

DETAILED DESCRIPTION OF THE PREFERRED EMBODIMENT

Figure 1:
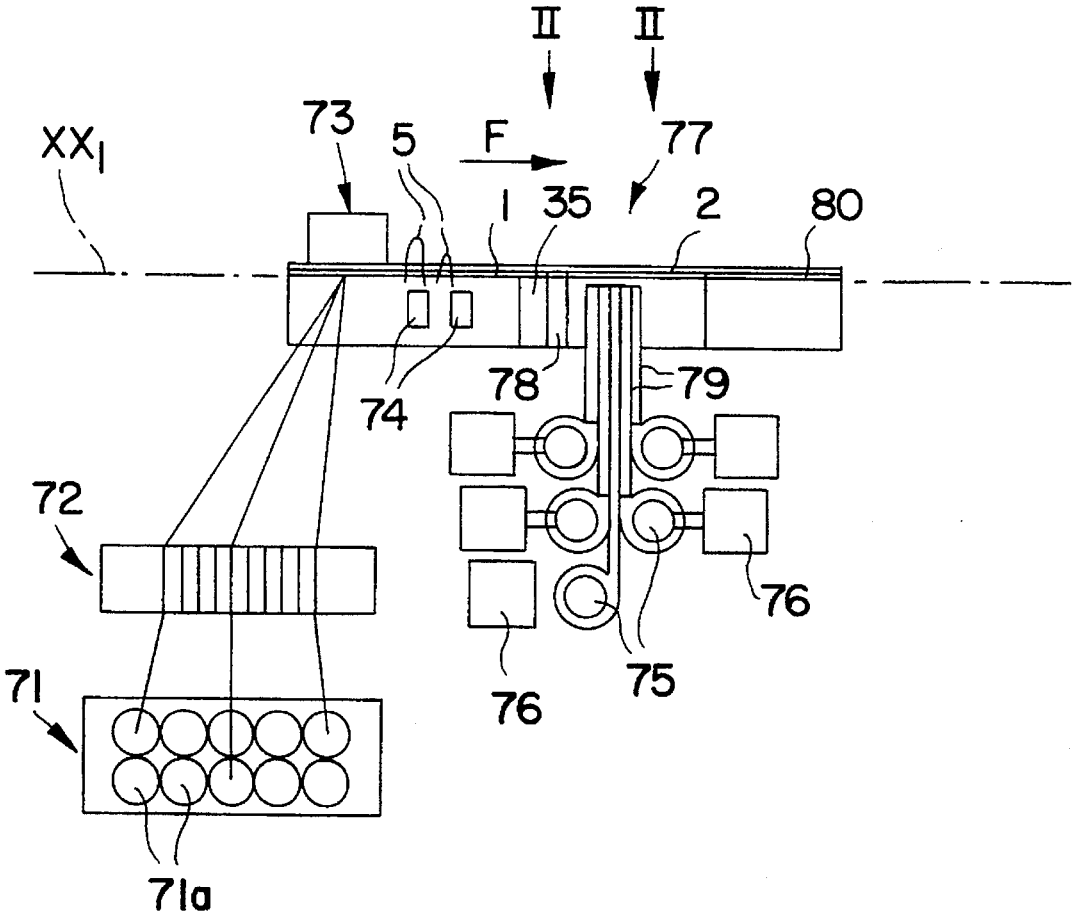
FIG. 1 shows a schematic plan view of the main components of the apparatus for manufacturing electrical able bundles according to the invention.

Referring now to FIG. 1, an apparatus for manufacturing electrical cable bundles according to the invention is seen comprising at least one carrier strip 1 oriented along a longitudinal axis $XX_1$, at least one second carrier strip 2 oriented along the projected plane of the first carrier strip 1, and at least one fourth carrier strip 80 which is oriented along the same plane of the second carrier strip 2. The apparatus also includes a means 71 of storing electrical wires, which means can include several wire-holding spools 71*a*. The electrical wires wound around each spool may be of different size and type and it is seen that the wire is supplied from each of the spools over guide means 72, towards a station 73. Station 73 selects the desired wire types and cuts the wires into sections; downstream of the station 73, the wire sections 5 can be transferred onto the first carrier strip 1 by transfer grippers (not shown) such that the wire ends can be moved successively to wire and preparation stations 74. The preparation stations 74 can either comprise wire and stripping stations or stations for crimping connections onto the wire ends.

As shown, downstream of the preparation stations 74, in the general direction of movement of the wire sections along the direction of arrow F, the apparatus also includes a wire section vertical positioning device 35 and a device 78 for transferring the transfer grippers onto a third carrier strip (not shown). The figure shows that once, the wire sections have been prepared and/or stripped at the preparation station 74 they are then transferred to a station 77 where the wire sections are assembled with the components (FIG. 2), in order to produce the electrical cable bundles. This figure shows that the assembly station 77 is comprised of the second carrier strip 2 and a component EE device 79, which is oriented perpendicular to the longitudinal axis $XX_1$ of the apparatus, wherein the feed device 79 is being supplied with components through magazines 76, each of which is loaded with a predetermined component type. Vibratory hopper feeders 75 set the components to a predetermined position on the feed device 79.

Figure 2:
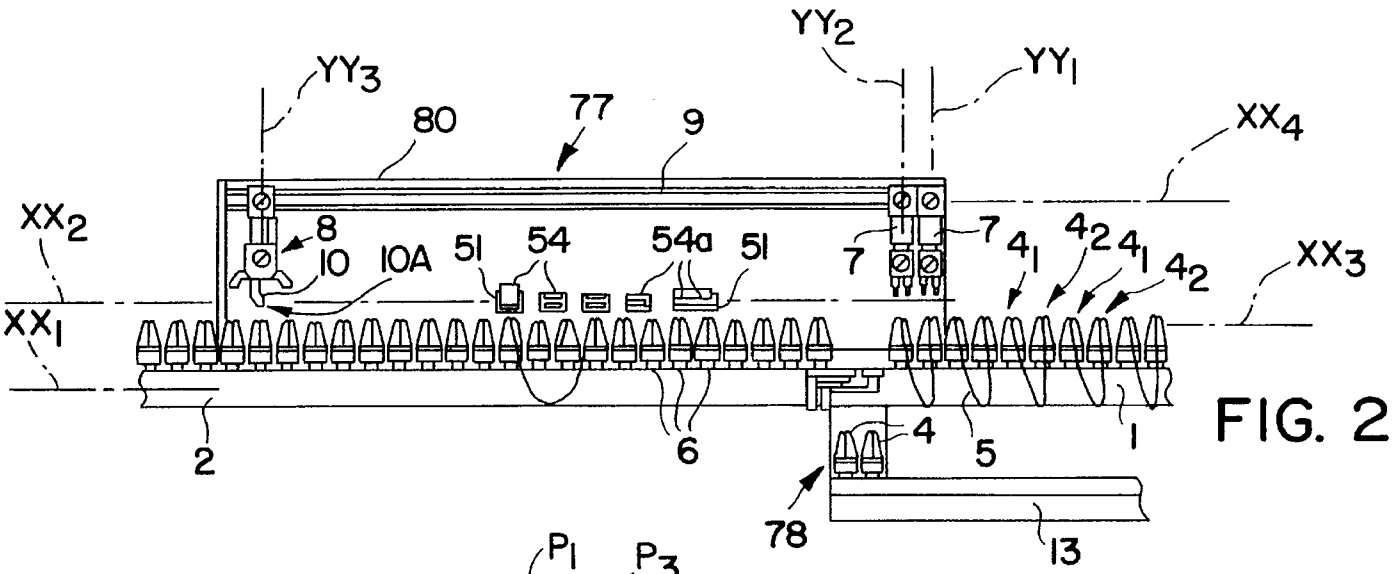
FIG. 2 shows a longitudinal side view of the main components of an electrical cable assembly station according to the invention.

Turning to FIG. 2, there is shown a top view taken along line II—II of FIG. 1 of a preferred embodiment of the electrical cable bundle assembly station according to the present invention. This figure further shows that the first carrier strip 1 conveys the adjacent transfer grippers $4_1$, $4_2$, each pair of adjacent transfer grippers $4_1$, $4_2$ conveying a wire section 5 that is held in the claws of the transfer grippers. The envisioned transfer grippers are of the type described in patent application EP 305 307.

As seen, first linear carrier strip 1 is oriented along a horizontal longitudinal axis $XX_1$ and second linear carrier strip 2 is oriented along the same horizontal plane of the first carrier strip, and is capable of conveying support grippers 6 which holds one or several wire section ends. The electrical cable bundle assembly station 77 comprises two mating grippers 7 oriented along vertical axes $YY_1$ and $YY_2$ respectively, and which move along horizontal axis $XX_4$, which is parallel to axis $XX_1$, on a rail or support 9 which extends the entire length of the assembly station 77. The components 54 which are delivered by the vibratory feed devices (not shown) can be brought in close proximity to the second carrier strip such that at least one of their front faces is located in confronting relationship to the wire ends. Each component is of a predetermined type which is to be included in the electrical cable bundles and is placed on a mobile insertion support 51, with respective component openings 54*a* facing said wire ends; each opening receives a wire section therein.

It should be emphasized that it is an advantage if all the openings 54*a* of the components are located at the same height along axis $XX_2$, said height being known as the insertion height and being located at a predetermined height relative to the axis $XX_1$.

The assembly station 77 also comprises at least one gathering gripper 8 oriented along a general vertical axis $YY_3$ and which can move along the horizontal guide or support 9 independently of the movement of the mating grippers 7. Gathering gripper 8 is fitted with a sweep arm 10, the lower end 10A of which is fitted with a jaw located at the insertion height, which corresponds with horizontal axis $XX_2$. When the gathering gripper 8 moves in the horizontal direction, the jaw at the lower end of the sweep arm 10 moves along axis $XX_2$ at the insertion height, and thus can gather or approach the wire ends which have previously been inserted into the openings in one of the components.

The figure also shows that the apparatus includes a device 78 for transferring the transfer grippers 4 from the first carrier strip 1 onto a third carrier strip 13 which is preferably a linear carrier strip located below and parallel to the first carrier strip 1.

Figure 3:
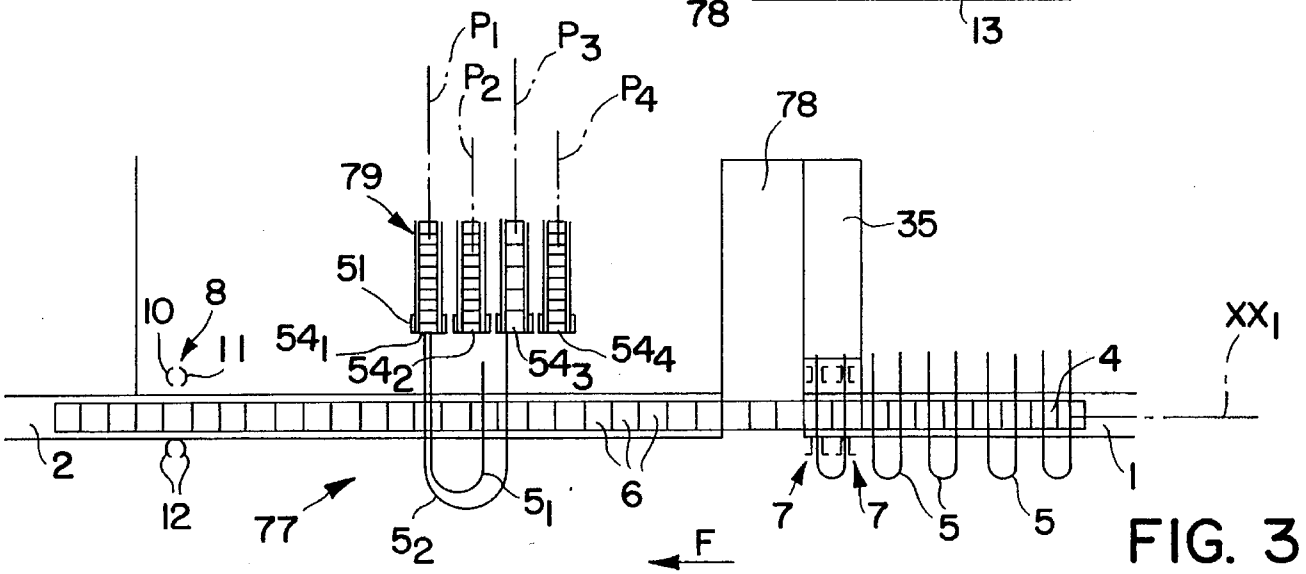
FIG. 3 shows a schematic plan view of the main components of an electrical cable bundle assembly station according to the invention.

FIG. 3 shows a schematic plan view of an electrical cable bundle assembly station 77, where it is seen that the apparatus comprises successively, following the direction of arrow F, the first carrier strip 1 which conveys the transfer grippers 4 to the device 35 for vertical positioning of the two wire ends of a wire section held by the ends of the transfer grippers 4. Situated furthest downstream of the apparatus, the second carrier strip 2 is situated on the same plane of the first carrier strip and conveys the support grippers 6 and the mating grippers 7, each of which is fitted with four claws, and at least one gathering gripper 8, fitted with the sweep arm 10, an internal articulated arm 11 and two external articulated arms 12, which are schematically represented by the symbol <>. This figure also shows that on each of the feed devices 79, the end located near the second carrier strip 2, is fitted with a mobile insertion support 51 which can receive respectively a component $54_1$, $54_2$, $54_3$ or $54_4$. As the figure shows, it is clear that all the wire section ends are situated on the same side of the first and second carrier strips, and that the mobile insertion supports 51 are situated at the end of the component feed devices which receive the wire ends.

The gathering gripper 8 comprises two arms 10 and 11 which are located on the same side of the second carrier strip 2 as the wire section ends, as well as the two arms 12 located on the other side of, or across, the second carrier strip, or more particularly, on the other side of the support gripper 6. In order to differentiate between the gripper arms that are located on the same side of the carrier strip as the wire ends, the term "internal" has been adopted for such arms. The term "external" will refer to arms located on the opposite side from the wire ends relative to the grippers. This figure also shows that two wire sections $5_1$ and $5_2$ are located in the electrical cable bundle assembly station 79, wherein each of the wire sections has a common end inserted into an opening of component $54_1$. Section $5_1$ has a second end which is being held in one of the support grippers 6 and is not inserted within an opening, while wire section $5_2$ has a second end inserted into an opening within a component $54_3$. The ends of the feed device 79 are oriented along axes $P_1$, $P_2$, $P_3$, $P_4$ which are perpendicular or transverse to the axis $XX_1$ and in which, according to the invention, lies along the curved trajectory of the component located at the end of the feed device and which forms the insertion trajectory for introducing the wire ends into the component openings.

FIG. 4*a* shows an end view of the insertion device 50 according to the invention and outlines a support gripper 6 conveyed along the second carrier strip 2, which is oriented along the axis $XX_1$, understood as extending into the plane of the paper. In this mode of embodiment, FIG. 4*a* illustrates that the second carrier strip 2 is comprised of a support profile 15 and that the upper part of support grippers 6 are fitted with claws 6*a*, capable of holding the wire section ends and which are mounted on a gripper body 6*b*. Although not shown here, it is to be understood that the support grippers 6 are identical to the transfer grippers 4. The gripper body is mounted on a base plate 6*c* which can slide inside the support profile 15 and is also fitted with lateral slots 6*d* used in particular to lock the support gripper 6 in position on the support profile 15 of the second carrier strip 2. The insertion device 50 mainly comprises a mobile insertion support 51 mounted on a mobile deck 62 wherein the mobile support 51 is fitted with a mobile plate 53 for placing the components 54 thereon. The insertion support 51 consists of side walls 46 and an interconnecting base 47 which form a hollow body for receiving a compression spring 52. Spring 52 rests against the base and supports the mobile plate 53, allowing it to move inside the hollow body of the mobile support 51 in the direction of vertical axis $YY_4$. The clamping cylinder 56 is supported by a support or beam 57 which is attached to the mobile deck 62.

A component feed actuator 59 also has a rod which is equipped with a plunger 59*a*, designed to push one or several components 54 placed on the feed device 79 and is retained at the end near the mobile insertion support by a stop 55 fitted on the end of a mobile stop cylinder 58.

The horizontal feed devices 79 are oriented along an axis $ZZ_{61}$ which is transverse to axis $XX_1$, and the feed actuator 59 is held by a vertical support 60 which is attached to a horizontal fixed deck 69. The mobile deck 62 can be moved relative to the fixed deck 69 by articulated arms or links $63_1$, $63_2$, the ends of which are fitted respectively with articulations $64_1$, $64_2$, $65_1$, $65_2$, relating to the mobile and fixed decks respectively. These links or articulated arms 63 are all of the same length and allow rotation of the links or arms relative to the decks, along an axis which projects into the plane of the paper (not shown). The assembly constituted by the links and decks (in this end view) forms a deformable parallelogram, and it is seen that one of the links $63_2$ is connected at an articulation point 66 to the rod of an insertion cylinder 67. The body of cylinder 67 is attached through an articulation point 68 to the fixed support 60 which extends into the plane of the paper, on an axis parallel to the axis $ZZ_{61}$.

FIG. 4*a* is illustrative of the insertion device 50 wherein the mobile insertion support 51 is in a position in which no component is placed on the mobile insertion support plate 53.

FIG. 4*b* operably shows the component $54_1$ located at the end of the row of components placed on the feed device 79 being pushed into position above the mobile plate 53 of the mobile insertion device, it being advantageous that mobile plate 53 is located along the projected plane of the feed guide. The component $54_1$ is retained by the stop connected to the mobile stop cylinder and the row of components is moved along the feed guide by the feed actuator 59, or more particularly by plunger $59_A$, which is operable along the direction of arrow F1.

FIG. 4*c* shows the next step in the operation in which the clamping cylinder 56 is actuated so that plunger 45 advances in the direction of the arrow F2 in order to move the component resting on mobile plate 53, as well as the mobile plate itself, thus compressing spring 52 to a predetermined position. When the component reaches the apogee of the curved insertion trajectory, the openings in the component being held are positioned at the insertion height. Advantageously, since the mobile insertion support 51 has a shape adapted to match the external shape of the component, the component is allowed to slide vertically, being guided by the side walls of the mobile insertion support, when it moves in the direction of the arrow F2. The predetermined clamping position of the component on the mobile plate of the mobile insertion support is such that the openings in the components are located above the upper part of the support grippers.

FIG. 4*d* shows the next operational step in which one of the mating grippers 7, partially and schematically represented in FIG. 4*k*, is placed confronting the insertion device. The mating gripper 7 is holding one prepared end 70 of a wire section 5 by its claws 30. After clamping of the component while still on the mobile plate of the mobile insertion support, the mobile stop 55 is moved in the direction of the arrow F3 by a return device fitted in the mobile stop cylinder 58 so that it comes into contact with the front part of the next component in the row of components on the feed device. During this phase, the feed actuator plunger 59A can return to its initial position by moving in the direction indicated by the arrow F4.

FIG. 4*e* shows the next operation, which is the actual insertion operation, in which the mating gripper 7 remains stationary while the mobile insertion support 51, the beam 57, and the mobile deck 62 are moved along a trajectory $T_1$, in this case circular, by means of the insertion cylinder 67. The cylinder 67 actuates at the articulation point 66, thereby rotating the links or arms 63 around the articulations 64 which connect the links to the fixed deck 69. The figure shows that in this particular mode of embodiment, the links, which have a free length $L_1$ between their articulations 64 and 65, are all equal, and this free length $L_1$ defines a radius R1 of the accurate trajectory path T1 in the plane perpendicular to the axis $XX_1$ of the first and second carrier strips. The trajectory path $T_1$ includes all upward phase followed by a downward phase, where the end of the wire section being held in the mating gripper 7, is inserted into the opening in the component 54 that is clamped onto the mobile support 51.

In the next operation shown in FIG. 4*f*, if all the openings of the component which is clamped onto the insertion support have had wire section ends inserted therein, then the gathering gripper 8 moves along the guide (not shown) into position confronting the insertion device. The sweep arm 10, the internal articulated arm 11 and the external articulated arms 12 then gather the wire section ends that are inserted into the component openings and once the arms of the gathering gripper have closed, the component can be released by the clamping gripper, which causes the compression spring 52 to trigger upwards movement of the component placed on the mobile plate of the mobile insertion support. Alternatively as shown in FIG. 4*g*, if all openings in the component 54 do not have wire ends inserted therein, then following the operation shown in FIG. 4*e*, the mating gripper 7 releases the wire section which has been inserted into the opening of component 54, then moves along the guide (not shown) to collect another wire end. As shown in FIG. 4*g*, the end 70 of the wire section 5 which has been inserted into the component 54 then remains suspended therein and the insertion cylinder 67 returns the mobile insertion device back from the second carrier strip along the direction of arrow F6 in order to allow another wire end to be delivered by a mating gripper (not shown on this figure), until the component 54 placed on the mobile insertion support has had wire ends inserted in all the required openings.

FIG. 4*h* shows the operation following the phase shown in FIG. 4*g*, in which a component has had wire ends inserted in all its openings. Here, the figure shows that the component 54 remains suspended from the wire ends which have been inserted into its openings, with the wire ends being held by the gathering gripper 8, which can then move along the guide (item 9 in FIG. 2) in order to move into position confronting one of the support grippers and to move along the direction of arrow F8, in order to introduce the wire ends within component 54 into the claws of a support griper. This figure also shows that the insertion cylinder moves in the direction of the arrow F7 in order to retract the mobile insertion support from the second carrier strip along an accurate, and in the case of FIG. 4*h*, a circular trajectory path which is identical to the insertion trajectory path, but operable in the opposite direction.

FIGS. 5*a* through 5*f* will now be referred to in order to illustrate how an electrical cable bundle is manufactured by the process and apparatus of the present invention.

FIG. 5*a*, which is similar to FIG. 3, shows the same vertical positioning device 35 with the wire section ends being held in the transfer grippers 4 that are placed on the first carrier strip 1. Also seen is the device 78 for transferring the transfer grippers 4 from the first carrier strip 1 to a third carrier strip (not shown), and the support grippers 6 which are placed on the second carrier strip 2 and oriented so as to be coextensive with the first carrier strip. Also shown are four component feed devices $54_1$, $54_2$, $54_3$, $54_4$, each of which contains rows of identical components, with each component feed device being provided with a different component type. It is an advantage that the insertion devices are identical and oriented along parallel axes which are preferably evenly spaced about one hundred millimeters apart. In this way, for simple electrical cable bundles requiring not more than ten or twenty components of different types, it is possible to install ten to twenty similar insertion devices within an extremely restricted linear space relative to a distance along the carrier strips. FIG. 5*a* shows that a first wire section $5_1$ has been gripped by two mating grippers 7, each of the mating grippers having four claws 30, represented in the figure by the opposed brackets, wherein two are internal claws and two are external claws. In this way, one end can be inserted into a first component, similar to the process shown in FIGS. 4*a* to 4*h*, while the second end can be inserted into a second component $54_2$ situated on another insertion device. After insertion of the end of the wire section $5_1$ the wire section remains suspended by its ends connected to the components $54_1$ and $54_2$ and as shown in FIG. 5*b*, the two mating grippers 7 then grip the next wire section situated furthest downstream along or towards the first carrier strip and then convey it along until one end of the second wire section $5_2$ is confronting an opening in the component $54_1$ with the other end of the same wire section confronting an opening in a third component $54_3$ placed on a third insertion device.

Following this operation, as shown in FIG. 5*c*, the two mating grippers have gripped a third wire section $5_3$ and have placed one of the ends of this third wire section in confronting relationship to the component $54_2$ and have placed the second end of the third wire section $5_3$, in confronting relationship to an opening in the component $54_3$, while at the same time, the gathering gripper 8 has moved (from left to right on the figure) and by means of the sweep arm 10, the internal articulated arm 11 and the external articulated arm 12, has gathered the wired ends already inserted into the opening in the component $54_1$. This component $54_1$ having already been released from the mobile insertion support by the clamping cylinder as shown in FIG. 4*f*, which allows the gathering gripper 8 to gather the wire ends and to introduce the wire ends into the support gripper $6_5$ on the second carrier strip 2. This figure also shows component $54_{11}$ succeeding the $54_1$ component in the same row on the first feed guide thereby positioning the next strip 0 on the mobile insertion support in a condition ready for insertion operations.

FIG. 5*d* shows the next level of operation where the gathering gripper 8, (the sweeping and articulated arms of which are shown schematically using the symbol <>) has gripped the wire ends which have been inserted into the component $54_2$, which is now completed. This component $54_2$ remains suspended by the wire ends which have been inserted into the openings and these wire ends can be introduced into a support gripper 6 $64_4$ by the gathering gripper. This figure also shows hat simultaneously, the two mating grippers 7 have gripped a fourth wire section 54, one of the mating grippers (the left most one in the figure) allowing insertion of the second end of the wire section 54 into an opening in the component $54_3$.

FIG. 5*e* shows that the gathering gripper 8 has gripped the ends which have been inserted in the component $54_3$ so that the ends are introduced into a support gripper $6_3$. The component $54_3$ having been released from the mobile insertion support, is suspended from its wire ends, by the gathering gripper into a support gripper $6_3$. Simultaneously, the mating grippers 7 have gripped a fifth wire section $5_5$, introduced one end of the wire section $5_5$ into the support gripper $6_2$ and aligned the second end of the wire section $5_5$ with an opening in a fourth component $54_4$ which was placed on a fourth mobile insertion support and supplied by a fourth component feed device.

FIG. 5*f* shows the last operation of the process, wherein the gathering grippers 8 have gripped the end of the wire section $5_5$ that has been inserted into the component $54_4$. As before, component $54_4$ has been released from the mobile insertion support. The gathering gripper is seen as having positioned and introduced the wire ends into one of the support grippers $6_1$ on the second carrierstrip 2. It is also seen that during the operations shown in FIGS. 5*a* to 5*f*, the second carrier strip 2 has advanced the support grippers 6 such that, as seen in FIG. 5*f*, a completed electrical cable bundle is being held in the support grippers $6_1$, $6_2$, $6_3$, $6_4$ and $6_5$ of the second carrier strip 2 and that, consecutively, the mating grippers 7 have gripped a new first wire sections $5_1$ in order to resume the continuous manufacturing of a second electrical cable bundle identical to the electrical cable bundle which was just completed. This new starting step is again shown in FIG. 5*a*.

FIG. 6 shows an end view of a gathering gripper 8 according to the invention, i.e. a view along a direction parallel to the longitudinal axis $XX_1$ of the first and second carrier strips.

FIG. 6 shows the gathering gripper 8 comprising the sweep arm 10, the internal articulated arm 11 and the external articulated arms 12. The internal articulated arm 12 and sweep arm 10, are separated from the external articulated arm 11 by a space of width L1, which is slightly larger than the width L2 of the upper part of the claws of the support gripper 6. This arrangement makes it possible to introduce the wire end(s) into the claws of the support gripper 6 located confronting the gathering gripper. This is done by also aligning the free space along the plane of FIG. 6 with the claws of the support gripper by moving the gathering gripper downwards in the direction of the arrow F, when the gathering gripper arms are holding one or several wire ends oriented along the axis $ZZ_8$. The internal articulated arm 11 can be actuated by a first linear cylinder 20 by means of a rod 20*a*, a fork 20*b* and a link 23, wherein the internal arm is rotated about an articulation axis $ZZ_3$ that is preferably common to the internal articulated arm and the external articulated arms. In the same way, the external articulated arms can be actuated by a second linear cylinder 21 through a cylinder rod 21*a*, a fork 21*b*, a beam 22 and links 23. FIG. 6 also shows that the gathering gripper 8 comprises a body 19 which provides a support for the first and second linear cylinders and the articulation axis $ZZ_3$.

FIG. 7*a* shows a partial sectional view taken along the line VII—VII of FIG. 6, in which the gathering gripper 8 is shown with the internal articulated arm 11 in the closed position, with no wire end held in the gathering gripper. It shows that it is of advantage that the sweep arm 10, being rigidly attached to the gripper body or support 19, comprises a protruding stop 18*a* located on the main vertical axis $YY_3$ of the gathering gripper, wherein axis $YY_3$ intersects the articulation axis $ZZ_3$. The lower ends of the internal articulated arm 11 and the sweep arm 10 are fitted with jaws 25, that slightly overlap when the arms are in a position where the gripper is closed. When the articulated arm is in this position, the articulated arm is at a limit position against the stop 18*a* which is fitted to the rigid sweep arm 10.

FIG. 7*b* is the same partial section view taken along Line VII—VII of FIG. 6, in which the gathering gripper 8 is now shown with the internal articulated arm 11 in the open position. It is seen that the internal arm 11 can rotate about the axis $ZZ_3$ driven by the first linear cylinder 20 and the link 23. The figure also shows that the lower end of the internal articulated arm 11 and of the sweep arm 10 comprises jaws 25 in which a V-shaped indentation is worked. The indentation has internal edges 25*a* which form an angle δ, which preferably is about 90 degrees. When the sweep arm 10 and the gathering gripper 8 move on the guide (item 9 in FIG. 2) along an axis parallel to the longitudinal axis of the carrier strips 1, 2, the bottom 25*d* of the V-shaped indentation in the sweep arm jaw will move along an axis $XX_5$, it being of advantage that this axis is located at the insertion height, so as to gather the wire ends into the V-shaped indentation in the sweep arm jaw.

FIG. 7*c* is a similar view to FIG. 7*b* in which the gathering gripper 8 and more specifically the internal articulated arm 11 is shown in a position where it is closed around the ends of a wire section 5 which have been gathered to form a kind of strand by the particular shape of the jaws of the sweep arm and internal articulated arm 11. The internal articulated arm 11 has been closed by means of the first linear cylinder 20, which pushed rod 20*a* downwards, causing translational movement of the fork 20*b* attached to the end of the rod, thereby causing the internal articulated arm to rotate around the axis $ZZ_3$ by means of the linear cylinder 20 and a link 23, one of which ends is free to rotate relative to the internal articulated arm, while the other end is free to rotate relative to the fork. In the position shown in FIG. 7*c*, the internal articulated arm 11 is forming a general angle 6 with the vertical, caused by the presence of the wire section 5 ends in the jaws of the internal articulated arm 11 and the sweep arm 10. The linear cylinder comprises a load limiting device capable of limiting cylinder travel when the wire ends are in held in the jaws, thus requiring a partial travel, or an opening stroke shorter than that shown in FIG. 7*a*, when the wire ends are present.

FIG. 8*a* is a partial sectional view taken along the line VIII—VIII of FIG. 6 which shows that the gathering gripper 8 comprises the second linear cylinder 21 oriented along an axis $YY_{32}$ and is fitted with a rod 21*a* having an end which is equipped with a fork 21*b*. Fork driving links 23 at the one end are articulated onto the external articulated arms 12*a* and 12*b*; the other end being articulated onto the beam 22 which is free to rotate relative to the fork 21*b*, about an axis $ZZ_{20}$. The figure shows articulated arms 12*a*, 12*b*, in the closed position with no wire ends being gripped by the arms, and it also shows that the lower ends of the arms 12*a* and 12*b*, i.e. the two jaws, partially overlap each other.

FIG. 8*b*, which is similar to FIG. 8*a*, shows the external articulated arms 12*a*, 12*b*, in the open position, and that the articulation axis $ZZ_{20}$ of the beam 22, relative to fork 21*b* being attached to linear cylinder rod 21, and offset from the general vertical axis $YY_3$ of the arms by a value β which is preferably as low as possible, for example, a few millimeters. On closure of the gripper, the external articulated arms are driven by the second linear cylinder 21 and follow respectively the circular trajectories T2 and T3, the center of which is the articulation axis $ZZ_3$, in order to gather the wire ends situated on the external side relative to the support grippers. It is seen that the gripper body 19 also comprises a stop 18*b* which inhibits the external articulated arm travel when these arms reach the closed position. Due to the offset β between the articulation axis of the beam, relative to the fork, and the articulation axis $ZZ_3$ of the arms relative to the gripper body, movement of the arms 12*a* and 12*b* will be delayed or staggered so that, as shown in FIG. 8*c*, the ends of the wire sections 5 can be gathered into a position similar to that shown in FIG. 7*c* for the internal articulated arm and the sweep arm. In the case where several wire ends have been gathered by the external articulated arms 12, as shown in FIG. 8*c*, one of the external articulated arms (for example, the right one) having reached the stop 18*b*, with the second external articulated arm (for example, the left one) form an angle Δ which is similar to the angle δ of FIG. 7*c*, whose value may be less than 10 degrees. The figure shows that in this position, the beam 22 is tilted away from the horizontal and the links $23_1$ and $23_2$ occupy a position dissymmetrical to the general vertical axis $YY_3$ of the gripper.

FIG. 9 shows an end view of a mating gripper 7 according to the invention which can be moved along the guide or shaft 9, and be of circular section, for example, a sliding device such as a ball sleeve. The mating gripper comprises a support or body 34 on which is mounted a vertical movement cylinder 33. The vertical movement cylinder 33 ensures movement relative to the mating gripper body or support 34 of an assembly comprising a cylinder, which actuates claws $30_1$ and $30_2$ and causes simultaneous vertical movement of a mobile flange 28 relative to the body 34 fitted with flanges 34*a* connected by spacers 26. The figure also shows that the internal claws $30_2$ and external claws $30_1$ of the mating gripper are spaced apart so as to allow the wires held by the mating gripper claws to be introduced into the claws of one of the support grippers (not shown).

It is of advantage that the lower lateral ends of the internal claws $30_2$ are fitted with extensions $30_a$, thereby allowing gripping of the wire end of the wire sections to be held by the mating gripper as close as possible to their ends in order to ensure a correct hold of the wire end, which facilitates insertion of the wire end into a component opening. FIG. 9 also shows a compressed air supply device 32*e*, for supplying air to the cylinder 32 which actuates the claws.

FIG. 10 shows a view taken along line X—X of FIG. 9, in which the claws 30 are shown in the closed position in contrast to the open position shown in FIG. 9. It is seen that the assembly consisting of the cylinder 32 and the mobile flanges 28, can move relative to the gripper body and to the fixed flanges 29 on the gripper body. This figure also shows that each internal claw $30_2$ is fitted with the claw extension 30*a* that ensure the correct hold of the wire section ends.

FIG. 11 is a view taken along line XI—XI of FIG. 9, showing that the assembly consists of cylinder 32 and that the claws can move by the gripper support and fixed flanges 29 along a track 27 that can be installed in the fixed flanges 29 so as to allow movement of the assembly through ball bearings 32*c* mounted on pin sections 32*b*, which are rigidly attached to the mobile assembly comprising the cylinder 32. The jaw actuating cylinder 32 can, by means of a rod 32*d* and a fork (item 41*c* in FIG. 12) common to the claws, cause downward movement of the upper ends of the claws. The central part of the claws on the other hand are attached by, respectively, links 41*a*, 41*b* which are articulated around a fixed axis $ZZ_7$ relative to the vertically mobile assembly (on mobile flanges 28), in order to approach the lower ends of the claws that are actuated by the cylinder 32. A central plunger 31*a* not actuated by the claw cylinder and is fixed relative to the vertically mobile assembly (on the mobile flanges 28), having a lower end 31*a* of triangular section with tilted sides 31*b* which separate the claws of the support gripper, thereby allowing introduction of the wire ends and also, when introducing a wire section held by the claws 30 into a support gripper, function to make insertion of the part of the wire section situated between the claws easier. This is done by means of the central plunger pushing the central part of the wire section in order to prevent distortion of the wire section and to prevent the wire section from slipping out of the mating gripper claws, and to overcome the opening load of the support gripper claws.

FIGS. 12 and 13 are respectively sectional views taken along lines XII—XII and XIII—XIII of FIG. 11. Each view shows that the mobile flanges 28 which are part of the vertically mobile assembly, can move relative to the fixed lateral flanges 29 on which the track 27 is mounted. FIG. 13 shows that the links 41*a* and 41*b* are articulated around a pin 41*d* of axis $ZZ_7$ which is fitted on the mobile flanges 28. FIG. 28 shows that the claws 30 can be driven by the jaw actuating cylinder through the common fork 41*c* and two pins 41*e*.

FIG. 14 shows an end view of the device for transferring the transfer grippers 4 from the first carrier strip 1 to the third carrier strip 13, which is located below the first carrier strip 1. It is seen that in this preferential mode of embodiment, the first carrier strip 1 comprises a support 15 having a triangular cross section that has one of its upper lateral faces (top right) with an embossed rib 16 which corresponds to a recessed rib 17 formed into the lower part of the body of the transfer gripper. The transfer gripper is thus able to slide between the upper lateral flanges of the profile 15 by means of its base 4*a*.

FIG. 14 also shows the third carrier strip 13 also comprises a support profile $\mathbf{15}_3$ which is identical to the support profile 15 of the first carrier strip. Support profile $\mathbf{15}_3$ is mounted in a reversed position for facilitating the transfer of transfer grippers 4. This figure also shows that the transfer gripper transfer device, also known as the elevator, includes a vertical guide system 83 for directing a sliding chock 84 which is considered the elevator proper, and which can be moved by a vertical translation cylinder 81 located at the base of a fixed structure which is rigidly attached to the rigid deck 69.

The transfer gripper transfer device also includes two plunger assemblies $\mathbf{84}_1$ and $\mathbf{84}_2$, with each plunger assembly comprising a cylinder 85 and a horizontal translation guide system 86 that authorizes movement of the plungers 82 in the direction of the arrows F1 and which further especially allows for plunger assembly $\mathbf{84}_1$, the extraction of one or two transfer grippers from the first carrier strip 1. The transfer gripper then is placed on the sliding chock 84 when this is in the upper position, confronting the plunger 82. The sliding chock can then be lowered by means of the cylinder 81 and the guide system 83 to the position shown in FIG. 14 where the second plunger assembly $\mathbf{84}_2$, which is also equipped with a cylinder and horizontal guide system, can push the transfer gripper(s) from the sliding chock onto the third carrier strip 13.

FIG. 15*a* is an end view showing an embodiment of the device for vertical positioning of the wire ends 70 held by the transfer gripper 4, wherein vertical positioning prior to gripping of the wires by the mating grippers 7 is ensured. FIG. 15*a* further shows that with this embodiment, the vertical positioning device 35 is mounted on the fixed deck 69, and comprises a cylinder 38 articulated about a fork 39 about axis $XX_{39}$. The vertical position can be adjusted relative to the fixed deck 69. The upper end of the cylinder 38 includes a mobile plate 37, articulated around an axis $XX_{37}$, and being connected to the cylinder 38, is moved through an articulation about an axis $XX_{38}$ which causes upwards or downwards movement of its internal face 37*a* according to a circular trajectory along the axis $XX_{37}$. FIG. 15*b* shows roughly the same view as FIG. 15*a* in a phase where, just prior to the wire ends 70 being held in the transfer gripper 4, are gripped by the mating grippers (not shown), the previously stripped or prepared wire ends 70*a* are positioned vertically through lowering the mobile plate 37. The internal face 37*a* of plate 37 corresponds with the internal face 36*a* of a fixed plate 36, and defines a blade shaped space with parallel faces that are thicker than the thickness of the stripped part of the wire end, thereby ensuring vertical positioning of the wire end by closure of the mobile plate to a predetermined position. Movement is caused by cylinder 38 and is articulated around an axis $XX_{37}$. FIG. 15*a* also shows that in the next operational phase, the claws 30 of the mating gripper 7 can now grip the end 70 of the wire section 5 held by the claws of the transfer gripper 4 which is now situated on the first carrier strip 1 in a position wherein the wire end is positioned at a predetermined height through the vertical positioning device 35; then the cylinder 38 is actuated in order to raise the mobile plate 37.

FIGS. 16 and 17 show a preferred embodiment of part of the insertion device comprising the mobile insertion support 51. FIGS. 16 and 17 also show that the clamping cylinder 56 and the mobile insertion device 51 are mounted on a support 49 which can be rotated about a vertical axis $YY_5$ by a rotary cylinder or motor 50 through a drive system. The drive system is comprised of two pulleys 43, a drive belt 44, and a first shaft 49*a*, which is immobilized on the support 49 by a key 49*b*, and by a second shaft 49*c* which ensures rotation of the lower part of the support 49 and the mobile insertion device 51 about the axis $YY_5$. The figures further show that, as described above, the mobile support 51 includes the mobile plate 53 which can move vertically during the clamping and unclamping operations, mobile plate 53 being fitted on a spring 52 which can distort along the vertical axis $YY_5$, with guides 48*a* on the side walls 46 of the mobile insertion device aligning the wire ends with the openings 54*a* in the components 54.

FIGS. 18*a* and 18*b* schematically show the insertion process portion of the operation according to the invention. FIG. 18*a* shows that a point P is linked to the components 54, which have at least one opening 54*a*, and follows a circular trajectory $T_1$ during the insertion phase. The mating gripper claws (partly and schematically shown) are holding the wire section 5 by its end 70, and it should be understood that part of end 70*a* has been stripped. Component 54 is mounted on the mobile insertion support (not shown), that is fitted with the guide 48, wherein one guide face 48*a*, guides the wire section into the opening during the insertion operation. The guide face 48*a* can form an angle A of approximately 20 degrees to the insertion direction, the guide 48 being of thickness $L_4$ and the opening 54*a* having a depth $L_5$.

FIG. 18*b* shows that in a preferred mode during the insertion process, point P reaches the apogee $P_1$ of the curved insertion trajectory relative to the compound, the wire end comes into contact with the guide face located nearest to the opening, at a median point $P_3$ of the surface of the guide, such that the horizontal axis of the wire end is offset by a height $H_1$ from the horizontal axis of the opening into which the wire end is to be inserted.

FIG. 18*c* shows that point P, relative to the component, has passed the apogee of the trajectory $T_1$ or radius $R_1$, and the wire end is being inserted into the opening.

FIG. 18*d* shows the end of the operation to insert the wire end into the opening, in which point P, relative to the component, has reached the end point $P_2$ of the trajectory. The distance $L_6$ between this end point and the apogee $P_1$, in the plane of the curved trajectory, which is along a direction parallel to the direction of the wire section, is approximately equal to the sum of the values $L_4$ and $L_5$. The figure further shows that in this position, the distance $L_3$ between the front face of the mobile insertion support guide and the end of the internal claw of the mating gripper is very small, typically about one millimeter.

I claim:

1. A wire gathering gripper device for handling and inserting a first and a second end of a section of wire into at least one opening of at least one electrical component, said component placed near a horizontal linear carrier strip having a horizontal axis comprising:

at least one rigid sweep arm, an internal articulated arm that cooperates with said sweep arm to gather said wire and after said ends have been inserted into said openings of one of the components; and two articulated external arms which coact with said internal arms to gather the wire section after the ends are inserted into the component, said external arms being at a predetermined distance from the component, wherein said wire end gathering gripper moves along a guide rail having an axis parallel to said horizontal axis.

2. The gripper device according to claim 1 wherein said internal articulated arm can be actuated by a first linear cylinder and wherein said external articulated arms can be actuated by a second linear cylinder, each of said cylinders having a respective thrust axis.

3. The gripper device according to claim 2 wherein said internal and external articulated arms extend between an open and a closed position with respect to a common vertical axis, which arms are articulated about a common horizontal axis which is normal to the vertical axis, wherein the thrust axis of said second linear cylinder is parallel to the common vertical axis, and is longitudinally displaced from the common vertical axis so as to cause an asymmetrical movement of said external articulated arms.

4. The gripper device according to claim 3, wherein the internal and external articulated arms of said gathering gripper each have an upper and lower end, each arm equipped at its lower end with at least one claw, each claw in the shape of a V, thereby defining internal claw edges which form an angle between 60 degrees and 120 degrees.

5. The gripper device according to claim 1 wherein each of said claws of said arms comprises at least two parts, each of said parts being generally planar and disposed parallel to each other, wherein when said gathering grippers are closed, one part of a second, corresponding claw partially covers the other part of the first claw.

6. An apparatus for manufacturing an electrical cable bundle from a plurality of wire sections, each having a pair of wire ends, comprising:

a first linear carrier strip disposed along a longitudinal axis, said first carrier strip having an upstream end and a downstream end, and including a plurality of adjacent transfer grippers, each of said transfer grippers capable of holding a wire section therein and operable on said carrier strip, said transfer grippers moving said wire ends to a vertical positioning and transferring device located at said downstream end of said strip;

a second linear strip in alignment with and disposed along said same longitudinal axis as said first carrier strip, said second carrier strip having a first end in confronting relationship to said downstream end of said first carrier strip, said second carrier strip including a plurality of support grippers operating thereon;

a third linear carrier strip located below said first carrier strip and arranged parallel thereto, said vertical positioning device capable of transferring said transfer grippers from said first carrier strip to said third carrier strip for insertion of at least one electrical component on each of said wire ends, said positioning and transferring device capable of placing said wire sections on said second carrier strip and in said support grippers;

a fourth linear carrier strip located above said second carrier strip and arranged parallel thereto, said fourth carrier strip including a plurality of mating grippers and gathering grippers operating thereon, said gathering grippers comprised of a sweep arm, an internal articulated arm, and two external articulated arms, said internal external articulated arms opposing said sweep arm and said internal articulated arm on an opposite side of said second carrier strip, said mating and gathering grippers moving said wire ends along said second carrier strip, said gathering grippers capable of moving along said fourth carrier strip independently of said mating grippers.

7. The apparatus according to claim 6 further including means for moving the component in relation to the ends of the wires held by mating grippers moving towards said wire ends according to a curved trajectory, said trajectory defined by an arc of a circle which defines a plane perpendicular to the first horizontal axis.

8. A process for manufacturing electrical cable bundles from a plurality of wire sections each having respective ends, which said ends are inserted into openings in electrical components, said process comprising the following steps:

procuring an apparatus for manufacturing electrical cable bundles; said apparatus including a device for handling a first and a second end of a section of wire, said device having a horizontal axis and including at least one rigid sweep arm, an internal articulated arm that cooperates with said sweep arm to gather said wire ends after said ends have been inserted into said openings of one of the components, and two articulated external arms which coact with said internal arms to gather the wire section after the ends are inserted into the component, said external arms being at a predetermined distance from the component, wherein said wire end gather gripper moves along a guide rail having an axis parallel to said horizontal axis;

manipulating at least two of the mating grippers by means of vertical movements along respective vertical axes of the mating grippers in order to grip said wire ends;

moving the mating grippers along a guide, so as to position at least one end of the wire in front of an opening of a component, wherein said component is held on a mobile insertion support;

moving the component and the mobile insertion support along a curved insertion trajectory;

holding a non-inserted end of the wire by the mating grippers and then inserting it in one of the support grippers;

opening claws of the mating grippers and then moving the mating grippers in order to position them opposite the transfer grippers, and at the same time when the component is linked to all the wire ends that are to be inserted into the openings of the component;

moving the gathering grippers along the guide, thereby allowing the bottom of the claw of the sweep arm to move along to a horizontal axis found at a same height as the openings of the component;

activating the internal articulated arm so as to gather the end of the wires near the component which have been inserted into the component in order to form a braid which is held by the claws of the internal articulated arm and the sweep arm;

activing the external articulated arms to gather the ends of wires which have been inserted into the component between the claws of the external articulated arms, said gathering occurring in an area away from the component;

separating the component from the mobile insertion support;

moving the gathering grippers along said guide in order to place the braid opposite one of the support grippers;

holding the braid, at the one end of which the component is attached in the support grippers.

* * * * *